US008426096B2

(12) United States Patent
Maezawa

(10) Patent No.: US 8,426,096 B2
(45) Date of Patent: Apr. 23, 2013

(54) CAPSULE TONER AND METHOD OF MANUFACTURING CAPSULE TONER

(75) Inventor: Nobuhiro Maezawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 478 days.

(21) Appl. No.: 12/759,984

(22) Filed: Apr. 14, 2010

(65) Prior Publication Data

US 2010/0266947 A1 Oct. 21, 2010

(30) Foreign Application Priority Data

Apr. 16, 2009 (JP) ..... P2009-100380

(51) Int. Cl.
*G03G 9/08* (2006.01)

(52) U.S. Cl.
USPC ..... 430/110.2; 430/137.11; 430/137.12; 430/137.15

(58) Field of Classification Search ..... 430/110.2, 430/137.11, 137.12, 137.15
See application file for complete search history.

(56) References Cited

U.S. PATENT DOCUMENTS

| | | | | |
|---|---|---|---|---|
| 4,915,987 | A | 4/1990 | Nara et al. | |
| 2005/0058927 | A1* | 3/2005 | Mikuriya et al. | 430/110.2 |
| 2006/0093945 | A1 | 5/2006 | Dalzell et al. | |
| 2007/0202427 | A1 | 8/2007 | Tanaka | |
| 2007/0218393 | A1 | 9/2007 | Nozaki et al. | |
| 2009/0297975 | A1 | 12/2009 | Ishikawa et al. | |
| 2010/0159374 | A1 | 6/2010 | Mutoh et al. | |

FOREIGN PATENT DOCUMENTS

| | | |
|---|---|---|
| JP | 4-182664 | 6/1992 |
| JP | 5-10971 | 2/1993 |
| JP | 2005-215607 | 8/2005 |
| JP | 2005-345760 | 12/2005 |
| JP | 2009-014757 | 1/2009 |
| JP | 2009-025669 A | 2/2009 |

OTHER PUBLICATIONS

U.S. Office Action mailed Jun. 13, 2012 is U.S. Appl. No. 12/707,028.

* cited by examiner

*Primary Examiner* — Mark A Chapman
(74) *Attorney, Agent, or Firm* — Nixon & Vanderhye P.C.

(57) ABSTRACT

A capsule toner in which fine solid particles constituting a shell layer are less likely to become detached from the surfaces of toner particles in spite of a long-term use within an image forming apparatus and which is capable of prevention of occurrence of filming on a photoreceptor drum, and a method of manufacturing the capsule toner are provided. The capsule toner includes core particle and shell layers for covering the surface of the core particle. The shell layer is formed of a plurality of fine polyester resin particles. The polyester resins contained in the fine polyester resin particles, respectively, are cross-linked to each other by a cross-linking agent.

6 Claims, 7 Drawing Sheets

CAPSULE TONER AND METHOD OF MANUFACTURING CAPSULE TONER

CROSS-REFERENCE TO RELATED APPLICATION

This application claims priority to Japanese Patent Application No. 2009-100380, which was filed on Apr. 16, 2009, the contents of which are incorporated herein by reference in its entirety.

BACKGROUND OF THE INVENTION

1. Field of the Invention

The present invention relates to a capsule toner for use in latent image development which is effected in an image forming apparatus such as an electrophotographic image forming apparatus or an electrostatic printing image forming apparatus, as well as to a method of manufacturing the capsule toner.

2. Description of the Related Art

There is known a capsule toner produced by forming a shell layer on the surfaces of core particles for improvement in toner preservability (heat resistance).

As an example of toner capsulation techniques, in Japanese Examined Patent Publication JP-B2 5-10971 (1993), there is disclosed a capsulated toner particle forming method involving a step where toner particles are caused to flow by rotating a rotary stirring section at a peripheral speed of 5 to 160 m/sec and a step where the toner particles (powder particles) in a fluidized state are sprayed with a liquid containing fine solid particles (coating material) by means of a spray nozzle. According to this method, it is possible to enhance the adherability between the coating material and the powder particles, as well as to shorten the time required for toner particle capsulation process.

However, in a case where a capsule toner obtained by the method disclosed in JP-B2 5-10971, more specifically a capsule toner formed by fixing fine solid particles constituting a shell layer to the surfaces of toner particles, is used within an image forming apparatus for a long period of time, the fine solid particles constituting the shell layer could become detached from the surfaces of toner particles. This presents the problem of possible occurrence of filming on a photoreceptor drum.

SUMMARY OF THE INVENTION

Accordingly, an object of the invention is to provide a capsule toner in which fine solid particles constituting a shell layer are less likely to become detached from the surfaces of toner particles in spite of a long-term use within an image forming apparatus and which is capable of prevention of occurrence of filming on a photoreceptor drum, and also provide a method of manufacturing the capsule toner.

The invention provides a capsule toner comprising:

a core particle; and a shell layer for covering a surface of the core particle, the shell layer being formed of a plurality of fine polyester resin particles each comprising polyester resins cross-linked to each other by a cross-linking agent.

According to the invention, the capsule toner comprises a core particle and a shell layer for covering a surface of the core particle. The shell layer is formed of a plurality of fine polyester resin particles. The polyester resin particles each comprises polyester resins cross-linked to each other by a cross-linking agent. Since polyester resin bears hydroxyl groups at the terminus thereof, in the shell layer made of the plurality of fine polyester resin particles, cross-linkage can be formed with stability. The plurality of fine polyester resin particles constituting the shell layer are fixed to the surfaces of the core particles, with the polyester resins comprised respectively in the fine polyester resin particles kept in a mutually cross-linked state. This makes it possible to prevent separation of the fine polyester resin particles constituting the shell layer from the core particle, and thereby protect a photoreceptor drum from filming with stability for a long period of time.

In the invention, it is preferable that the core particle comprises polyester resin, and the polyester resin comprised in the core particle and the polyester resins comprised in the fine polyester resin particles constituting the shell layer are cross-linked to each other by a cross-linking agent.

According to the invention, the core particle comprises polyester resin, and the polyester resin comprised in the core particle and the polyester resin comprised in the fine polyester resin particles constituting the shell layer are cross-linked to each other by a cross-linking agent. Therefore, the plurality of fine polyester resin particles constituting the shell layer can be fixed to the surfaces of the core particles more firmly. This makes it possible to protect the photoreceptor drum more effectively from filming resulting from separation of the fine polyester resin particles constituting the shell layer.

The invention also provides a method of manufacturing a capsule toner using a rotary stirring apparatus, the rotary stirring apparatus comprising:

a rotary stirring section including a rotary disk having rotary blades installed therearound and a rotary shaft, for stirring capsule particles each composed of a core particle and a plurality of fine polyester resin particles adhering to surface of the core particle under application of impact force;

a circulating section having a powder passage including a circulating tube and a rotary stirring chamber to accommodate the rotary stirring section, and circulating the capsule particles in the powder passage by an air current produced by rotation of the rotary blades; and a spraying section for spraying a plasticizing liquid for plasticizing the fine polyester resin particles onto the capsule particles, the plasticizing liquid containing a cross-linking agent for developing cross linkage between the polyester resins comprised in the plurality of fine polyester resin particles, respectively, the method comprising:

a film-forming process of forming a shell layer by spraying the plasticizing liquid onto the capsule particles so as to achieve cross linkage and fusion bonding between the polyester resins comprised in the plurality of fine polyester resin particles, respectively.

According to the invention, the method of manufacturing a capsule toner employs the rotary stirring apparatus comprising: the rotary stirring section including a rotary disk having rotary blades installed therearound and a rotary shaft, for stirring capsule particles each composed of a core particle and a plurality of fine polyester resin particles adhering to the surface of the core particle under application of impact force; the circulating section having a powder passage including a circulating tube and a rotary stirring chamber to accommodate the rotary stirring section, and circulating the capsule particles in the powder passage by an air current produced by rotation of the rotary blades; and the spraying section for spraying a plasticizing liquid for plasticizing the fine polyester resin particles constituting a shell layer onto the capsule particles.

The plasticizing liquid contains a cross-linking agent for developing cross linkage between the polyester resins comprised in the plurality of fine polyester resin particles, respectively. The method includes the film-forming process of forming the shell layer by spraying the plasticizing liquid onto the capsule particles so as to achieve cross linkage and fusion bonding between the polyester resins comprised in the plurality of fine polyester resin particles, respectively.

By virtue of the provision of the film-forming process in which, at the surfaces of the plurality of fine polyester resin particles constituting the shell layer, the polyester resins comprised respectively in the fine polyester resin particles are cross-linked to each other by the cross-linking agent, even if the strength of the impact force exerted on the capsule particles is decreased at the time of fixing the fine polyester resin particles to the surface of the core particle, a tough shell layer can be formed successfully. As a result, it is possible to protect the photoreceptor drum from filming resulting from separation of the fine polyester resin particles constituting the shell layer, as well as to prevent excessive spheronization of the surface shape of the resultant capsule toner, and thereby prevent occurrence of a cleaning failure on the photoreceptor and a transfer belt.

Further, in the invention, it is preferable that the cross-linking agent is made of an isocyanate compound.

According to the invention, the cross-linking agent is made of an isocyanate compound. In this case, a cross-linking reaction between the terminal hydroxyl group of polyester resin contained in the surfaces of the fine polyester resin particles and the isocyanate compound proceeds at an adequate reaction rate. This makes it possible to eliminate the need to secure much time for the cross linkage and thereby prevent aggregation of capsule toner particles in the film-forming process.

The invention further provides a method of manufacturing a capsule toner using a rotary stirring apparatus, the rotary stirring apparatus comprising:

a rotary stirring section including a rotary disk having rotary blades installed therearound and a rotary shaft, for stirring capsule particles each composed of a core particle and a plurality of fine polyester resin particles adhering to the surface of the core particle under application of impact force;

a circulating section having a powder passage including a circulating tube and a rotary stirring chamber to accommodate the rotary stirring section, and circulating the capsule particles in the powder passage by an air current produced by the rotation of the rotary blades;

a temperature regulation section disposed in at least a part of the powder passage, for regulating the temperatures of the interior of the powder passage and the rotary stirring section to predetermined temperatures; and a spraying section for spraying a plasticizing liquid for plasticizing the fine polyester resin particles onto the capsule particles, the method comprising:

a film-forming process of spraying the plasticizing liquid onto the capsule particles while causing the capsule particles to flow by rotating the rotary stirring section continuously until the plurality of fine polyester resin particles are softened into a film-like form, the plasticizing liquid containing an isocyanate compound, the rotary stirring section being operated at an outermost peripheral speed falling within a range of 30 m/s or above and 120 m/s or below, and an internal temperature in the powder passage falling within a range of 30° C. or higher and 65° C. or lower.

According to the invention, the method of manufacturing a capsule toner includes the film-forming process. In the film-forming process, the capsule particles are sprayed with the plasticizing liquid, and the rotation of the rotary stirring section is continued until the fine polyester resin particles are softened into a film-like form. The rotary stirring apparatus adopted for use in the film-forming process comprises: the rotary stirring section including a rotary disk having rotary blades installed therearound and a rotary shaft, for stirring capsule particles each composed of a core particle and a plurality of fine polyester resin particles adhering to the surface of the core particle under application of impact force; the circulating section having a powder passage including a circulating tube and a rotary stirring chamber to accommodate the rotary stirring section, and circulating the capsule particles in the powder passage by an air current produced by the rotation of the rotary blades; the temperature regulation section disposed in at least a part of the powder passage, for regulating the temperatures of the interior of the powder passage and the rotary stirring section to predetermined temperatures; and the spraying section for spraying a plasticizing liquid for plasticizing the fine polyester resin particles onto the capsule particles.

The plasticizing liquid contains an isocyanate compound. The peripheral speed at the outermost periphery of the rotary stirring section is set to fall within the range of 30 m/s or above and 120 m/s or below. The internal temperature in the powder passage falls within the range of 30° C. or higher and 65° C. or lower. Under those conditions, the polyester resins comprised respectively in the plurality of fine polyester resin particles can be cross-linked to each other. Moreover, since the strength of the impact force exerted on the capsule particles can be decreased, it is possible prevent excessive spheronization of the surface shape of the resultant capsule toner. Accordingly, there is obtained a capsule toner characterized by preventing filming on the photoreceptor drum resulting from separation of the fine polyester resin particles constituting the shell layer, and by preventing occurrence of a cleaning failure on the photoreceptor and the transfer belt.

In the invention, it is preferable that the concentration of the isocyanate compound contained in the plasticizing liquid falls within the range of 1% by weight or more and 20% by weight or less.

According to the invention, the concentration of the isocyanate compound contained in the plasticizing liquid falls within the range of 1% by weight or more and 20% by weight or less. In this case, the isocyanate compound can be applied evenly to the fine polyester resin particles borne on the surfaces of the capsule particles, with consequent prevention of aggregation of capsule toner particles in the film-forming process.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
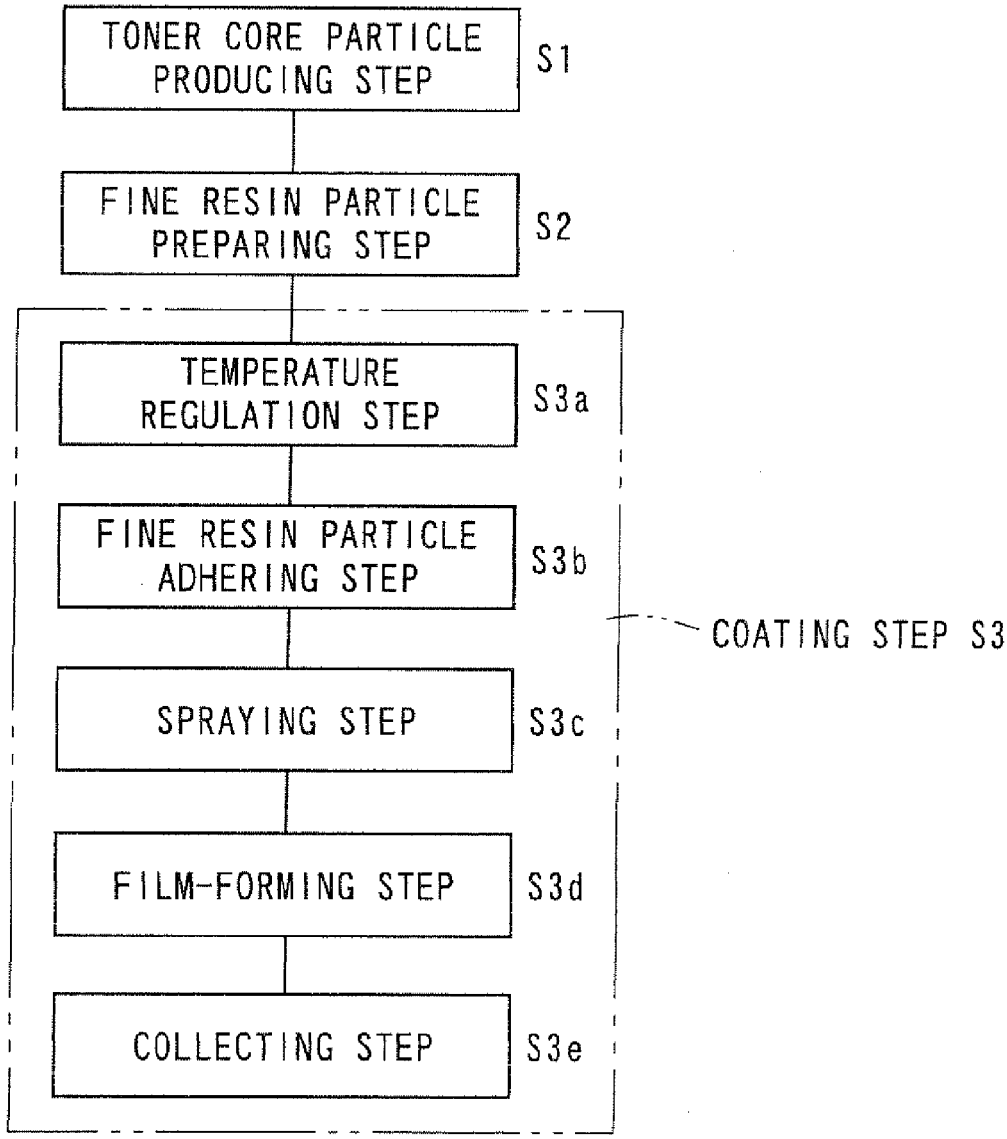
FIG. 1 is a flowchart of an example of a procedure for a method of manufacturing a capsule toner according to an embodiment of the invention.

Now referring to the drawings, preferred embodiments of the invention will be described in detail.

1. Toner

The capsule toner in accordance with a first embodiment of the invention comprises a toner core particle and shell layers for covering the surface of the toner core particle. The shell layer is formed of a plurality of fine polyester resin particles. Polyester resins comprised in the plurality of fine polyester resin particles, respectively, are cross-linked to each other by a cross-linking agent. Since polyester resin bears hydroxyl groups at the terminus thereof, in the shell layer made of the plurality of fine polyester resin particles, cross-linkage can be established with stability. The plurality of fine polyester resin particles constituting the shell layer are fixed to the surface of the toner core particle, with the polyester resins comprised respectively in the fine polyester resin particles kept in a mutually cross-linked state. This makes it possible to prevent separation of the fine polyester resin particles constituting the shell layer from the toner core particles, and thereby protect a photoreceptor drum from filming with stability for a long period of time.

(1) Toner Core Particles (Binder Resin)

As described above, the toner core particles each comprise the binder resin and the colorant. The binder resin is not particularly limited and any known binder resin used for a black toner or a color toner is usable, and examples thereof include a styrene resin such as a polystyrene and a styrene-acrylic acid ester copolymer resin, an acrylic resin such as a polymethylmethacrylate, a polyolefin resin such as a polyethylene, a polyester, a polyurethane, and an epoxy resin. Further, a resin obtained by polymerization reaction induced by mixing a monomer mixture material and a release agent may be used. The binder resin may be used each alone, or two or more of them may be used in combination.

Among those binder resin materials, polyester is particularly desirable as a binder resin for use in a color toner from the viewpoint of providing excellent transparency and imparting satisfactory powder flowability, fixability at low temperature, secondary color reproducibility, and so forth to capsule toner particles. Moreover, in a case where polyester resins are comprised in the toner core particles and the polyester resins comprised in the toner core particles and the polyester resins comprised in the fine polyester resin particles constituting the shell layer are cross-linked to each other by a cross-linking agent, the plurality of fine polyester resin particles constituting the shell layer can be fixed to the surfaces of the toner core particles more firmly. This makes it possible to protect the photoreceptor drum more effectively from filming resulting from separation of the fine polyester resin particles constituting the shell layer.

For polyester, heretofore known substances may be used including a polycondensation of polybasic acid and polyvalent alcohol.

For polybasic acid, substances known as monomers for polyester can be used including, for example: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and methyl-esterified compounds of these polybasic acids. The polybasic acids may be used each alone, or two or more of them may be used in combination.

For polyvalent alcohol, substances known as monomers for polyester can also be used including, for example: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic dials such as ethylene oxide adduct of bisphenol A and propylene oxide adduct of bisphenol A. The polyvalent alcohols may be used each alone, or two or more of them may be used in combination.

A polycondensation reaction between a polybasic acid and a polyvalent alcohol can be induced by means of a conventional method. For example, a polybasic acid and a polyvalent alcohol are brought into contact with each other in the presence of an organic solvent and a polycondensation catalyst to develop a polycondensation reaction between them. The polycondensation reaction is terminated upon each of the acid value, the softening temperature, and so forth of the resultant polyester reaching a predetermined value. In this way, polyester can be obtained. Depending on circumstances, there is no need to use an organic solvent. In a case where a methyl esterified compound of a polybasic acid is used as part of the polybasic acid, a de-methanol polycondensation reaction takes place. In developing this polycondensation reaction, by making changes to the blending ratio between the polybasic acid and the polyvalent alcohol, the reaction rate, or other factors in an appropriate manner, for example, it is possible to control the content of a carboxylic group at the terminus of polyester and thus change the properties of the resultant polyester. Moreover, in a case where a trimellitic acid anhydride is used as the polybasic acid, a carboxyl group can be easily introduced into the main chain of the polyester, whereby modified polyester can be obtained.

As the polyester resin, it is possible to use self-dispersible polyester capable of exhibiting self-dispersibility in water that is obtainable by connecting a hydrophilic group such as a carboxyl group or a sulfonic acid group to the main chain and/or the side chain of polyester. It is also possible to use a resin material formed of polyester and an acrylic resin in a grafted state.

It is preferred that the binder resin have a glass transition temperature of 30° C. or higher and 80° C. or lower. The binder resin having a glass transition temperature lower than 30° C. easily causes the blocking that the toner thermally aggregates inside the image forming apparatus, which may decrease preservation stability. The binder resin having a glass transition temperature higher than 80° C. lowers the fixing property of the toner onto a recording medium, which may cause a fixing failure.

(Colorant)

Examples of the colorant include a black colorant, a yellow colorant, an orange colorant, a red colorant, a purple colorant, a blue colorant, a green colorant, and a white colorant. Organic dyes, organic pigments, inorganic dyes, inorganic pigments, and the like adopted for common use in the field of electrophorography can be used.

Examples of black colorant include carbon black, copper oxide, manganese dioxide, aniline black, activated carbon, non-magnetic ferrite, magnetic ferrite, and magnetite.

Examples of yellow colorant include chrome yellow, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, and C.I. pigment yellow 185.

Examples of orange colorant include red chrome yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Examples of red colorant include red iron oxide, cadmium red, red lead, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of purple colorant include manganese purple, fast violet B, and methyl violet lake.

Examples of blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Examples of green colorant include chromium green, chromium oxide, pigment green B, malachite green lake, final yellow green G, and C.I. pigment green 7.

Examples of white colorant include those compounds such as zinc oxide, titanium oxide, antimony white, and zinc sulfide.

The colorants may be used each alone, or two or more of the colorants of different colors may be used in combination. Further, two or more of the colorants with the same color may be used in combination. A usage of the colorant is not limited to a particular amount, and preferably 5 parts by weight to 20 parts by weight, and more preferably 5 parts by weight to 10 parts by weight based on 100 parts by weight of the binder resin.

The colorant may be used as a masterbatch to be dispersed uniformly in the binder resin. Further, two or more kinds of the colorants may be formed into a composite particle. The composite particle is capable of being manufactured, for example, by adding an appropriate amount of water, lower alcohol and the like to two or more kinds of colorants and granulating the mixture by a general granulating machine such as a high-speed mill, followed by drying. The masterbatch and the composite particle are mixed into raw materials of the toner core particles at the time of dry-mixing.

(Charge Control Agent)

The toner core particle may comprise a charge control agent in addition to the binder resin and the colorant. For the charge control agent, charge control agents commonly used in this field for controlling a positive charge and a negative charge are usable.

Examples of the charge control agent for controlling a positive charge include a basic dye, a quaternary ammonium salt, a quaternary phosphonium salt, an aminopyrine, a pyrimidine compound, a polynuclear polyamine compound, an aminosilane, a nigrosine dye, a derivative thereof, a triphenylmethane derivative, a guanidine salt and an amidin salt.

Examples of the charge control agent for controlling a negative charge include an oil-soluble dye such as an oil black and a spirone black, a metal-containing azo compound, an azo complex dye, a naphthene acid metal salt, a metal complex or metal salt (the metal is a chrome, a zinc, a zirconium or the like) of a salicylic acid or of a derivative thereof, a boron compound, a fatty acid soap, a long-chain alkylcarboxylic acid salt and a resin acid soap. The charge control agents may be used each alone, or optionally two or more of them may be used in combination. Although the amount of the charge control agent to be used is not particularly limited and can be properly selected from a wide range, 0.5 part by weight or more and 3 parts by weight or less is preferably used based on 100 parts by weight of the binder resin.

(Release Agent)

Further, the toner core particle may comprise a release agent in addition to the binder resin and the colorant. As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax.

A usage of the release agent may be appropriately selected from a wide range without particularly limitation, and is preferably 0.2 part by weight or more and 20 parts by weight or less, more preferably 0.5 part by weight or more and 10 parts by weight or less, and particularly preferably 1.0 part by weight or more and 8.0 parts by weight or less based on 100 parts by weight of the binder resin.

(2) Shell Layer

As has already been described, the shell layer is formed of a plurality of fine polyester resin particles. The polyester resins comprised in the fine polyester resin particles, respectively, are cross-linked to each other by a cross-linking agent.

The fine polyester resin particles need to be made smaller enough in volume average particle size than the toner core particles. The volume average particle size of the fine polyester resin particles should preferably fall within the range of 0.05 μm or more and 1 μm or less, and more preferably at from 0.1 μm or more and 0.5 μm or less. By setting the volume average particle size of the fine polyester resin particles to fall within the range of 0.05 μm or more and 1 μm or less, it is possible to allow the fine polyester resin particles to adhere to the surfaces of the toner core particles, to get soft, to form a film, and to exhibit a cross-linked structure with ease.

Instead of being formed solely of the polyester resin, the fine polyester resin particles may contain additionally a resin material other than the polyester resin. This resin material may be of either a resin material of the same kind as the binder resin contained in the toner core particles or a resin of different type.

It is preferable that the resin used as a raw material for the fine polyester resin particles has a softening temperature higher than the softening temperature of the binder resin contained in the toner core particles. In this case, in the capsule toner produced by the manufacturing method of the present embodiment, fusion bonding of the constituent capsule toner particles can be prevented during storage with consequent improvement in storage stability.

It is preferable that the softening temperature of the resin used as the raw material for the fine polyester resin particles falls within the range of 80° C. or higher to 140° C. or lower, depending on the type of an image forming apparatus in which the capsule toner is used. With use of the resin having a softening temperature within such a range, there is obtained a capsule toner which is excellent in both storage stability and fixability.

2. Method of Manufacturing Capsule Toner

FIG. 1 is a flowchart of an example of a procedure for the method of manufacturing a capsule toner according to the second embodiment of the invention. The method for manufacturing a capsule toner of this embodiment includes a toner core particle producing step S1, a fine resin particle preparing step S2, and a coating step S3.

(1) Toner Core Particle Producing Step

At the toner core particle producing step of step S1, toner core particles to be coated with a shell layer are produced. The toner core particles are particles each containing a binder resin and a colorant and can be obtained with a known method without particular limitation to a producing method thereof. Examples of the method of producing toner core particles include dry methods such as pulverization methods, and wet methods such as suspension polymerization methods, emulsion aggregation methods, dispersion polymerization methods, dissolution suspension methods and melting emulsion methods. The method of producing toner core particles using a pulverization method will be described below.

(Method of Producing Toner Core Particles by a Pulverization Method)

In a method of producing toner core particles using a pulverization method, a toner composition containing a binder resin, a colorant and other additives is dry-mixed by a mixer, and thereafter melt-kneaded by a kneading machine. The kneaded material obtained by melt-kneading is cooled and solidified, and then the solidified material is pulverized by a pulverizing machine. Subsequently, the toner core particles are optionally obtained by conducting adjustment of a particle size such as classification.

Usable mixers include heretofore known mixers including, for example, Henschel-type mixing devices such as HENSCHEL MIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., PCM-65/87 and PCM-30, both of which are trade names and manufactured by Ikegai, Ltd., and open roll-type kneading machines such as KNEADEX (trade name) manufactured by Mitsui Mining Co., Ltd. Among them, the open roll-type kneading machines are preferable.

Examples of the pulverizing machine include a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine capable of removing excessively pulverized toner core particles by classification with a centrifugal force and classification with a wind force is usable and an example thereof includes a revolving type wind-force classifying machine (rotary type wind-force classifying machine).

(Toner Core Particle)

The toner core particles obtained at the toner core particle producing step S1 preferably have a volume average particle size of 4 μm or more and 8 μm or less. In a case where the volume average particle size of the toner core particles is 4 μm or more and 8 μm or less, it is possible to stably form a high-definition image for a long time. Moreover, by reducing the particle size to this range, a high image density is obtained even with a small amount of adhesion, which generates an effect capable of reducing an amount of toner consumption. In a case where the volume average particle size of the toner core particles is less than 4 μm, the particle size of the toner core particles becomes too small and high charging and low fluidity are likely to occur. When the high charging and the low fluidity occur, a toner is unable to be stably supplied to a photoreceptor and a background fog and image density decrease are likely to occur. In a case where the volume average particle size of the toner core particles exceeds 8 μm, the particle size of the toner core particles becomes large and the layer thickness of a formed image is increased so that an image with remarkable granularity is generated and the high-definition image is not obtainable, which is undesirable. In addition, as the particle size of the toner core particles is increased, a specific surface area is reduced, resulting in decrease in a charge amount of the toner. When the charge amount of the toner is reduced, the toner is not stably supplied to the photoreceptor and pollution inside the apparatus due to toner scattering is likely to occur.

(2) Fine Resin Particle Preparing Step

At the fine resin particle preparing step of step S2, preparation of dried fine polyester resin particles is conducted. Any method can be adopted to let the fine polyester resin particles dry, and more specifically so-called heated-air direct drying technique, conduction heat-transfer drying technique, far-infrared radiation drying technique, and microwave radiation drying technique may be given by way of examples. The fine polyester resin particles are used as a material for covering the surfaces of the toner core particle at the subsequent coating step S3. By applying a coating of the fine polyester resin particles to the surface of the toner core particle, for example, during developer storage, it is possible to prevent capsule toner aggregation resulting from the melting of a low melting-point component such as a releasing agent contained in the toner core particle. Moreover, by making proper adjustment to the fine polyester resin particles in respect of their film-like state for covering the toner core particles, the fine polyester resin particles can be shaped into a film, with their irregularities retained on the surfaces of the toner core particles; that is, the original form of the fine polyester resin particles can be retained in the resultant capsule toner. This makes it possible to obtain a capsule toner which is more excellent in cleanability than a toner having smoothed surfaces.

For example, the fine polyester resin particles can be obtained by performing granulation on the resin used as the raw material for the fine polyester resin particles by means of emulsification dispersion using a homogenizer or the like, or obtained by the polymerization of resin monomer components.

(3) Coating Step

<Rotary Stirring Apparatus>

Figure 2:
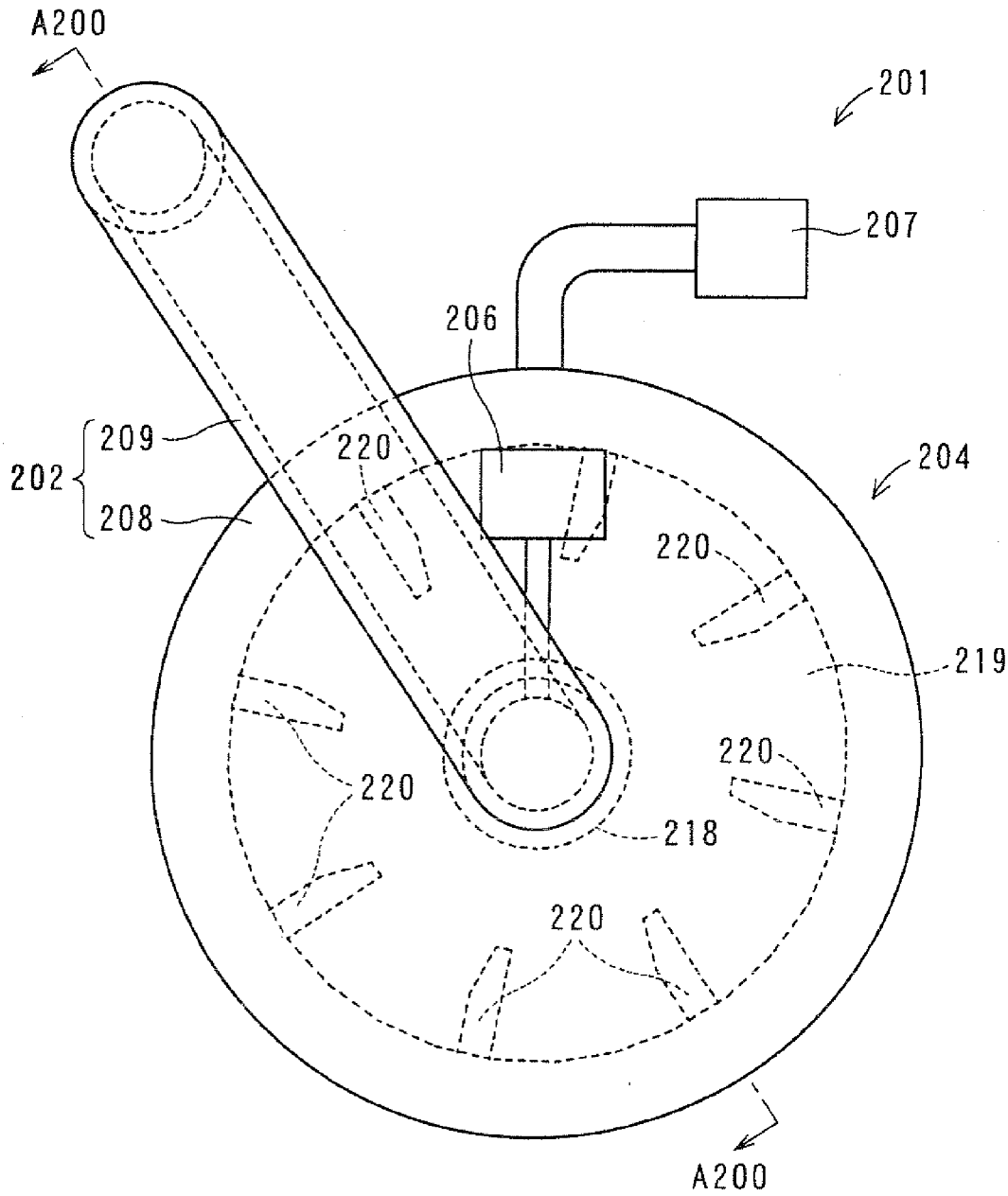
FIG. 2 is a front view of a configuration of a rotary stirring apparatus.
Figure 3:
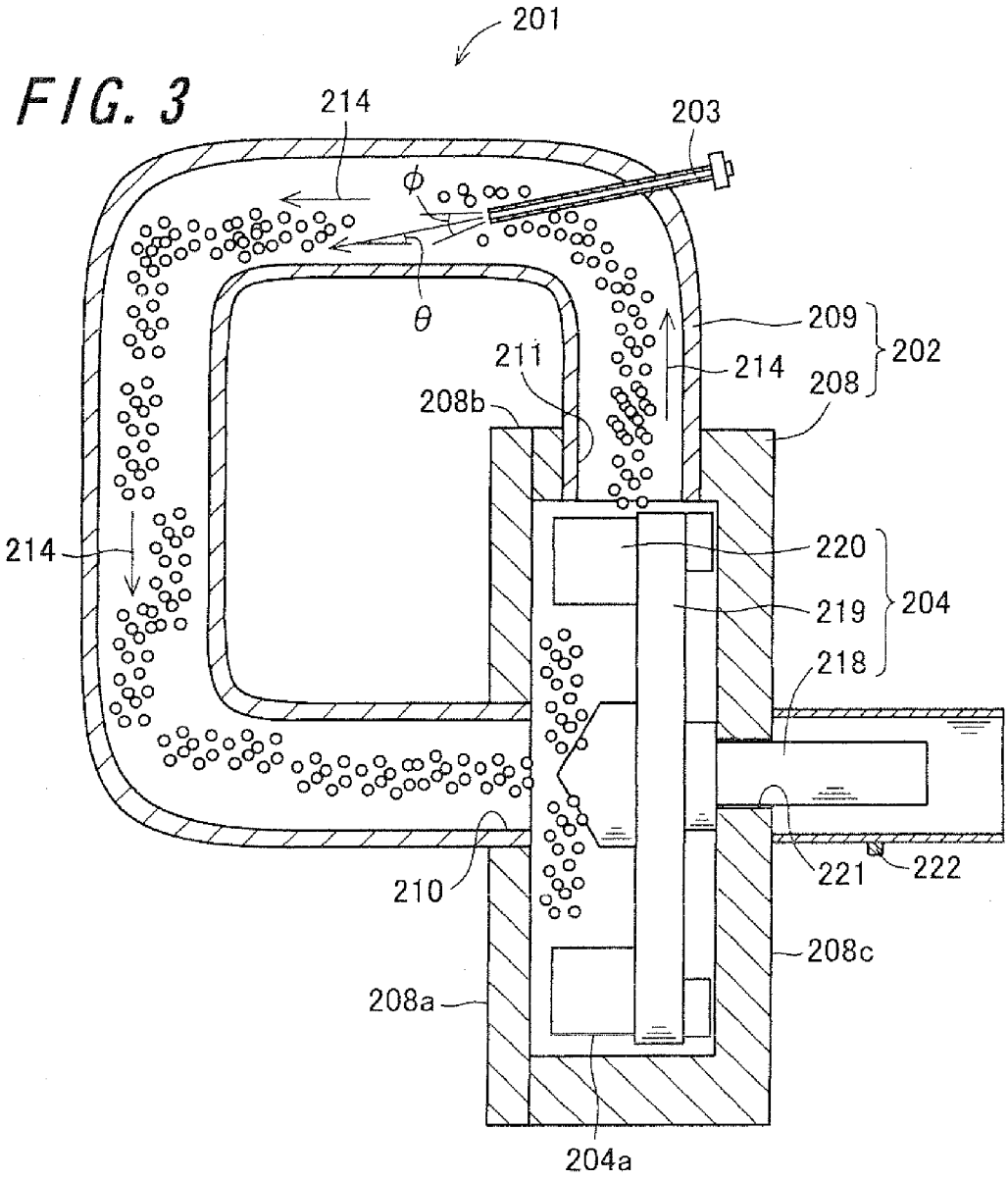
FIG. 3 is a schematic sectional view of the rotary stirring apparatus shown in FIG. 2 taken along a cross-sectional line A200-A200.

At the coating step of step S3, a rotary stirring including at least a circulating section, a temperature regulation section and a spraying section is used. FIG. 2 is a front view of a configuration of a rotary stirring apparatus 201. FIG. 3 is a schematic sectional view of the rotary stirring apparatus 201 shown in FIG. 2 taken along the cross-sectional line A200-A200. At the coating step of step S3, for example, using the toner manufacturing apparatus 201 shown in FIG. 2, the fine polyester resin particles prepared at the fine resin particle preparing step of step S2 are adhered to the toner core particle produced at the toner core particle producing step of step S1 to form a shell layer on the surface of toner core particle by a synergetic effect of circulation by a circulating section, an impact force of stirring in the apparatus and regulating temperatures by a temperature regulation section.

The circulating section 201 is comprised of a powder passage 202, a spraying section 203, a rotary stirring section 204, a temperature regulation jacket (not shown), a powder inputting section 206, and a powder collecting section 207. The rotary stirring section 204 and the powder passage 202 constitute a circulating section.

(Powder Passage)

The powder passage 202 is comprised of a stirring section 208 and a powder flowing section 209. The stirring section 208 is a cylindrical container-like member having an internal space. Openings 210 and 211 are formed in the stirring section 208 which is a rotary stirring chamber. The opening 210 is formed at an approximate center part of a surface 208*a* in one side of the axial direction of the stirring section 208 so as to penetrate a side wall including the surface 208*a* of the stirring section 208 in a thickness direction thereof. Moreover, the opening 211 is formed at a side surface 208*b* perpendicular to the surface 208*a* in one side of the axial direction of the stirring section 208 so as to penetrate a side wall including the side surface 208*b* of the stirring section 208 in a thickness direction thereof. The powder flowing section 209 which is a circulating tube has one end connected to the opening 210 and the other end connected to the opening 211. Whereby, the internal space of the stirring section 208 and the internal space of the powder flowing section 209 are communicated to form the powder passage 202. The toner core particles, the fine polyester resin particles and gas flow through the powder passage 202. The powder passage 202 is provided so that a powder flowing direction which is a direction in which the toner core particles and the fine polyester resin particles flow is constant.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring section 208, that is provided so as to be inserted into a through-hole 221 penetrating a side wall including a surface 208*c* disposed on the other side of the axial direction of the stirring section 208, in a thickness direction thereof, and that is rotated around its axis by a motor (not shown). The rotary disc 219 is a discotic member having the axis supported by the rotary shaft member 218 so as to match the axis of the rotary shaft member 218 and rotating with rotation of the rotary shaft member 218. The plurality of stirring blades 220 are supported by the peripheral edge of the rotary disc 219 and are rotated with rotation of the rotary disc 219.

The rotary shaft member 218 is rotatable at peripheral speed of 50 m/sec or more in an outermost periphery. The outermost periphery is a part of the rotary stirring section 204 that has the longest distance from the rotary shaft member 218 in the direction perpendicular to the rotary shaft member 218.

(Spraying Section)

The spraying section 203 is disposed in a part of the powder flowing section 209 of the powder passage 202 which is closest to the opening 211 as seen in a flowing direction in which the toner core particles and the fine polyester resin particles flow. The spraying section 203 includes: a liquid storage portion (not shown) for storing a plasticizing liquid for assisting the toner core particles and the fine polyester resin particles to adhere to each other; a carrier gas supply portion (not shown) for effecting the supply of carrier gas; and a two-fluid nozzle 230 for squirting the toner core particles and the fine polyester resin particles present in the powder passage 202 with the plasticizing liquid and the carrier gas to effect spraying of plasticizing liquid droplets onto the toner core particles and the fine polyester resin particles.

Figure 4:
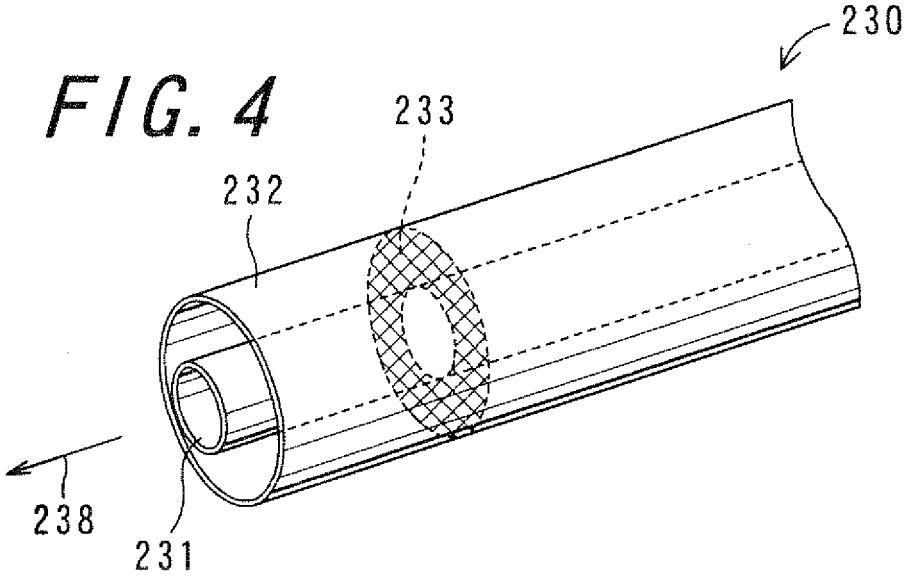
FIG. 4 is a plan view schematically showing the structure of a two-fluid nozzle.

FIG. 4 is a plan view schematically showing the structure of the two-fluid nozzle 230. In the embodiment, the two-fluid nozzle 230 comprises a liquid pipe 231 and an air pipe 232, and the liquid pipe 231 is inserted in the air pipe 232 such that the axis of the liquid pipe 231 coincides with the axis of the air pipe 232. A fixing member 233 for fixing the air pipe 232 and the liquid pipe 231 is provided in the air pipe 232. Thus, by fixing at least a part of the liquid pipe 232 and the air pipe 231, a structure that the centers of those pipes do not move is obtained. The fixing member for fixing at least a part of the liquid pipe 231 and the air pipe 232 is not particularly limited so long as flow of a carrier gas is not prevented and the centers of the liquid pipe 231 and the air pipe 232 can be prevented from being moved. The embodiment uses a mesh material. Furthermore, the fixing member is not limited to a structure that an inner wall of the air pipe and an outer wall of the liquid pipe are fixed with the fixing member. The air pipe 232 and the liquid pipe 231 may separately be fixed. The plasticizing liquid and the carrier gas are sprayed in a direction of the arrow 238.

The inner diameter of the liquid pipe 231 of the two-fluid nozzle 230 is preferably 0.5 mm or more and 2.0 mm or less. The inner diameter of the air pipe 232 is preferably 1.0 mm or more and 5.0 mm or less. Ratio of the inner diameter of the air pipe 232 to the inner diameter of the liquid pipe 231 is preferably 1:3. The more the ratio of the inner diameter of the air pipe 232 to the inner diameter of the liquid pipe 231 is away from the range, spraying state of the substance in liquid form becomes worse and aggregate is easily generated. The fixing member provided in the air pipe 232 is preferably arranged at the position near the tip of the air pipe 232. A material of the two-fluid nozzle 230 is not particularly limited, and any material that can be processed by molding or processed by cutting as a nozzle can be used. Examples of the material include various irons and steels such as iron, carbon steel and stainless steel; non-ferrous metals such as copper, aluminum, titanium and nickel; ceramics; plastics, glass fibers; carbon fibers; and reinforced (composite) plastic materials reinforced with metal fibers or the like. Among them, stainless steel is particularly preferred.

Figure 5:
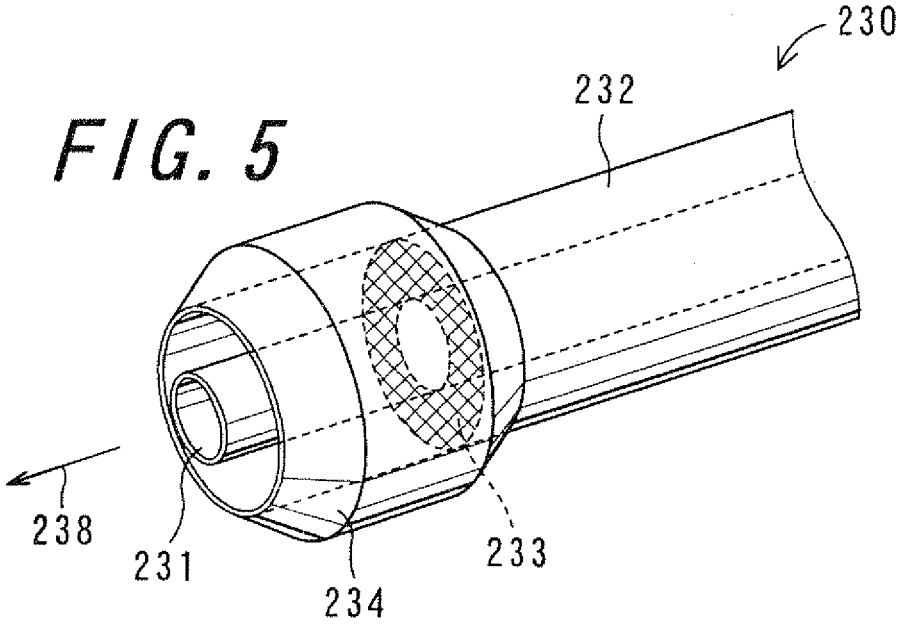
FIG. 5 is a plan view schematically showing the structure of the two-fluid nozzle having an adhesion preventive member provided thereon.
Figure 6:
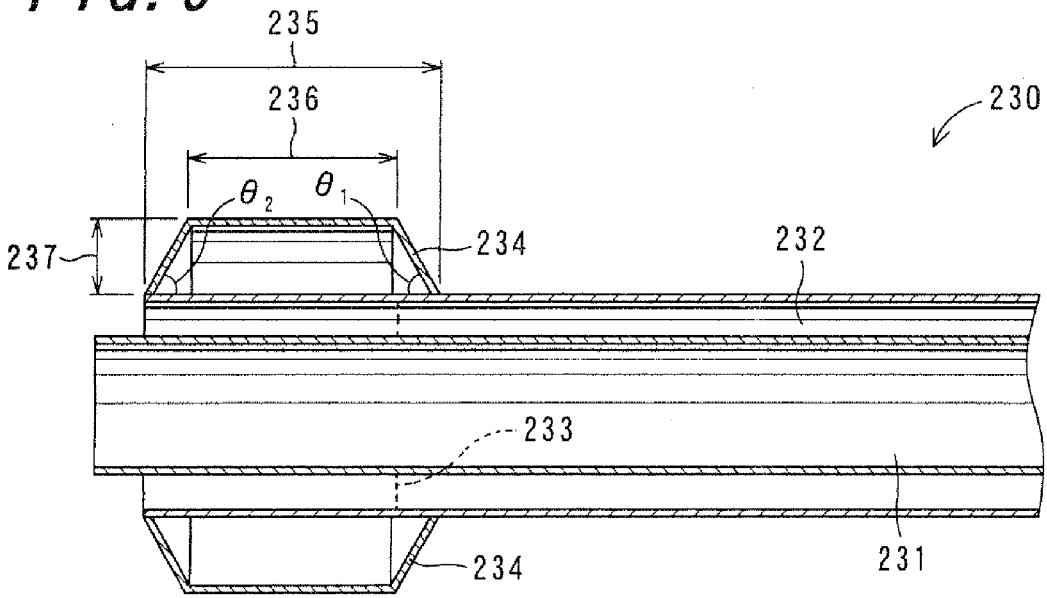
FIG. 6 is a cross-sectional view schematically showing the structure of the two-fluid nozzle having the adhesion preventive member provided thereon.

An adhesion preventive member 234 having a given thickness in an outward direction of a radius of the periphery of the air pipe 232 is preferably provided in the tip of the air pipe 232. FIG. 5 is a plan view schematically showing the structure of the two-fluid nozzle 230 having the adhesion preventive member 234 provided thereon. FIG. 6 is a cross-sectional view schematically showing the structure of the two-fluid nozzle 230 having the adhesion preventive member 234 provided thereon. The arrangement of the adhesion preventive member 234 can prevent the toner core particles and the fine polyester resin particles turning around toward the tip of the liquid pipe 231 for spraying a plasticizing liquid and the tip of the air pipe 232 for spraying a carrier gas from adhering to the tips. Therefore, a spraying direction of the plasticizing liquid does not change, the amount of a carrier gas sprayed per unit area is constant in the cross-section of the tip of the air pipe 232, and further stable spraying state can be maintained. As a result, a capsule toner having uniform film state and particle size distribution can be manufactured in a stable manner over a long period of time.

As shown in FIG. 6, the cross-section of the adhesion preventive member 234 in a direction of axis of the air pipe 232 is trapezoid, and of the mutually parallel two sides of the trapezoid, a longer side 235 is preferably in contact with the periphery of the air pipe 232. By providing the adhesion preventive member 234 having the cross-section, even though the toner core particles and the fine polyester resin particles collide with the adhesion preventive member 234, those particles are not blocked by the adhesion preventive member 234. Therefore, the yield of a capsule toner having uniform film state and particle size distribution can be improved.

In FIG. 6, angles $\theta_1$ and $\theta_2$ between two sides other than the mutually parallel two sides 235 and 236 and the longer side 235 in the mutually parallel two sides are 10° or more and 60° or less, respectively. Where the angle of $\theta_1$ and $\theta_2$ is too small, the effect that can prevent the toner core particles and the fine resin particles turning around toward the tip of the liquid pipe 231 and the tip of the air pipe 232 from adhering to the tips is not sufficiently exhibited. Where the angle of $\theta_1$ and $\theta_2$ is too large, the toner core particles and the fine polyester resin particles are easily blocked by the adhesion preventive member 234.

Length of the sides 235 and 236 and height 237 of the trapezoid in the cross-section of the adhesion preventive member 234 vary depending on a size of the two-fluid nozzle 230 used by a scale of the rotary stirring apparatus 201, that is, length and inner diameter of the liquid pipe 231 and the air pipe 232. Therefore, it is preferred that those are appropriately adjusted according to a size of the two-fluid nozzle 230 used.

[Temperature Regulation Jacket]

Returning to FIGS. 2 and 3, a temperature regulation jacket (not shown) serving as a temperature regulation section is provided in at least a part of the outside of the powder passage 202. Cooling medium or heating medium is passed through a space inside the jacket, and the temperature in the powder passage 202 and the temperature of the rotary stirring section 204 are regulated to a given temperature. By this regulation, the temperature in the powder passage 202 and the temperature of the outside of the rotary stirring section 204 can be controlled to a temperature lower than the temperature at which the toner core particles and the fine polyester resin particles introduced at a fine resin particle adhesion step S3*b* do not get soft or deform. At a spraying step S3*c* and a film-forming step S3*d* described hereinafter, variation in temperature applied to the toner core particles, the fine polyester resin particles and the plasticizing liquid is decreased, and this makes it possible to maintain the toner core particles and the fine polyester resin particles in a stable fluidized state.

The toner core particles and the fine resin particles, comprising a synthetic resin or the like generally collide with the inner wall of the powder passage many times. At the collision, a part of collision energy is converted into heat energy, and the heat energy is stored in the toner core particles and the fine polyester resin particles. With increasing the number of collision, the heat energy stored in those particles is increased, and then the toner core particles and the fine polyester resin particles get soft and adhere to the inner wall of the powder passage. However, by passing a cooling medium or a heating medium through the space in the jacket to regulate the temperature as described before, adhesion force of the toner core particles and the fine polyester resin particles to the inner wall of the powder passage is reduced. As a result, adhesion of the toner base particles to the inner wall of the powder passage 202 due to rapid increase in temperature in the apparatus can surely be prevented, and the powder passage can be suppressed form being narrowed by the toner core particles and the fine polyester resin particles. Accordingly, the toner core particle is uniformly coated with the fine polyester resin particles, and a capsule toner coated with a shell layer can be manufactured in high yield.

In the inside of the powder flowing section 209 downstream of the spraying section 203, the plasticizing liquid sprayed is not dried and remains therein. Where the temperature is not appropriate, drying rate becomes slow, and the plasticizing liquid easily remains. Where the toner core particles are in contact with the residual liquid, the toner core particles are easily adhered to the inner wall of the powder passage 202. This may be the generation source of aggregation of the toner core particles. On the inner wall in the vicinity of the opening 210, the toner core particles flowing into the stirring section 208 from the opening 210 by passing through the powder flowing section 209 easily collide with the toner core particles fluidized in the stirring section 208 by the stirring with the rotary stirring section 204. By this, the toner core particles collided are easily adhered to the vicinity of the opening 210. Therefore, adhesion of the toner core particles to the inner wall of the powder passage can further securely be prevented by providing the temperature regulation jacket in an area to which the toner core particles are easily adhered.

(Powder Inputting Section and Powder Collecting Section)

Figure 7:
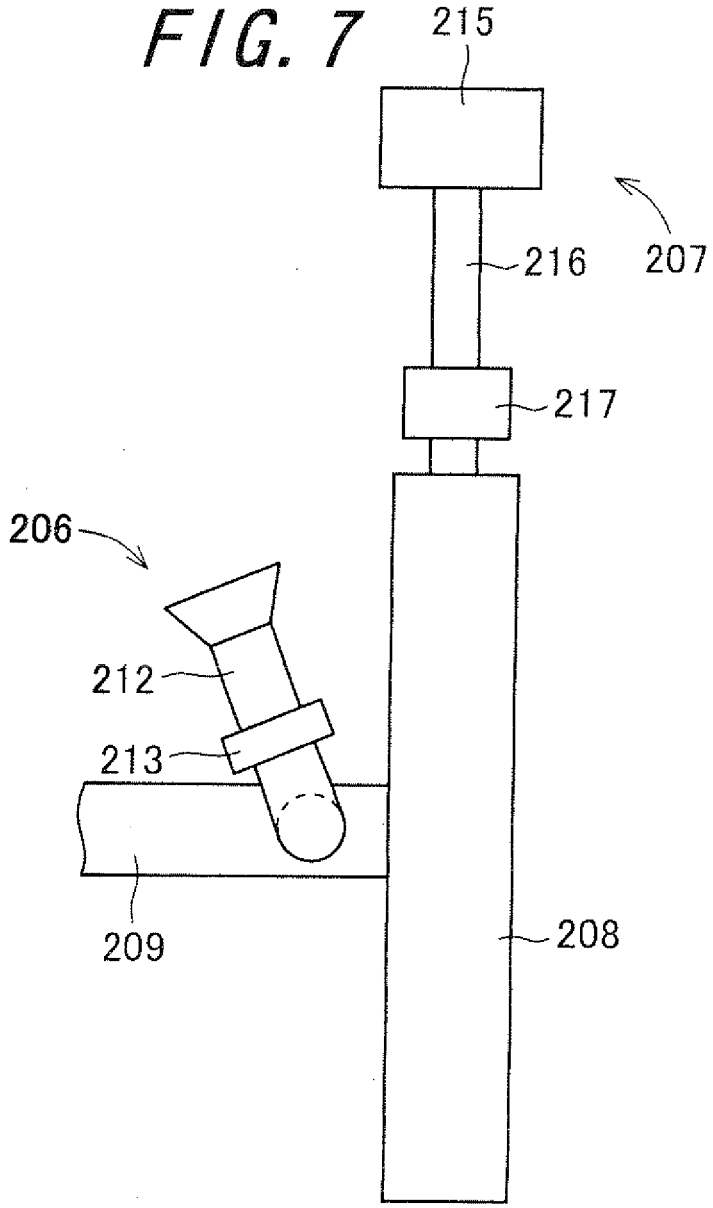
FIG. 7 is a front view of a configuration around a powder inputting section and a powder collecting section.

The powder flowing section 209 of the powder passage 202 is connected to the powder inputting section 206 and the powder collecting section 207. FIG. 7 is a front view of a configuration around the powder inputting section 206 and the powder collecting section 207. The powder inputting section 206 includes a hopper (not shown) that supplies the toner core particles and the fine polyester resin particles, a supplying tube 212 that communicates the hopper and the powder passage 202, and an electromagnetic valve 213 provided in the supplying tube 212. The toner core particles and the fine resin particles supplied from the hopper are supplied to the powder passage 202 through the supplying tube 212 in a state where the passage in the supplying tube 212 is opened by the electromagnetic valve 213. The toner core particles and the fine polyester resin particles supplied to the powder passage 202 flow in the constant powder flowing direction with stirring by the rotary stirring section 204. Moreover, the toner core particles and the fine polyester resin particles are not supplied to the powder passage 202 in a state where the passage in the supplying tube 212 is closed by the electromagnetic valve 213.

The powder collecting section 207 includes a collecting tank 215, a collecting tube 216 that establishes the communication between the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217. Moreover, the toner particles flowing through the powder passage 202 are not collected in a state where the passage in the collecting tube 216 is closed by the electromagnetic valve 217.

The coating step S3 where the thereby constructed rotary stirring apparatus 201 is used includes a temperature regulation step S3*a*, a fine resin particle adhering step S3*b*, a spraying step S3*c*, a film-forming step S3*d*, and a collecting step S3*e*. The spraying step S3*c* and the film-forming step S3*d* correspond to the film-forming process.

(3)-1 Temperature Regulation Step S3*a*

At the temperature regulation step of step S3*a*, while the rotary stirring section 204 is rotated, temperatures in the powder passage 202 and of the rotary stirring section 204 are regulated to a predetermined temperature by passing a medium through the temperature regulation jacket disposed on the outside thereof. This makes it possible to control the temperature in the powder passage 202 at a temperature or less at which the toner core particles and the fine polyester resin particles that are input at the fine resin particle adhering step S3*b* described below are not softened and deformed.

At the step, not only a part of the powder passage 202 but the whole of the powder passage 202 and the rotary stirring section 204 are preferably temperature-regulated. By this temperature regulation, as compared with the case that only a part of the powder passage is temperature-regulated, adhesion of the fine polyester resin particles to the toner core particles and film formation proceed smoothly, and adhesion of the toner core particles and the fine polyester resin particles to the wall surface of the powder passage can further be suppressed. As a result, the inside of the powder passage 202 can be suppressed from being narrowed by the adhesion of the toner core particles and the fine polyester resin particles thereto. Accordingly, the toner core particles are uniformly coated with the fine polyester resin particles, and a capsule toner having uniform film state and particle size distribution can be manufactured in a more stable manner over a long period of time.

(3)-2 Fine Resin Particle Adhering Step S3*b*

At the fine resin particle adhering step of step S3*b*, the toner core particles and the fine polyester resin particles are fed to the powder passage 202 from the powder inputting section 206, with the rotary shaft member 218 of the rotary stirring section 204 kept in a rotating state. The toner core particles and the fine polyester resin particles, now put in the powder passage 202, are stirred by the rotary stirring section 204 so as to flow in a direction indicated by an arrow 214 in the powder flowing section 209 of the powder passage 202. In this way, the fine polyester resin particles adhere to the surfaces of the toner core particles, whereupon capsule particles are formed.

(3)-3 Spraying Step S3*c*

At the spraying step of step S3*c*, a plasticizing liquid having an effect of assisting adhesion between the toner core particle and the fine polyester resin particles in a fluidized state and plasticizing the particles without dissolving those particles, is sprayed from the spraying section 203 by carrier gas. The plasticizing liquid is fed to the spraying section 203 by a liquid feeding pump with a constant flow amount and the plasticizing liquid sprayed by the spraying section 203 is gasified so that the gasified plasticizing liquid is spread on the surface of the toner core particles and the fine resin particles. Whereby, the capsule particles are plasticized.

(Plasticizing Liquid)

Although there is no particular limitation to the selection of the plasticizing liquid having the effect of facilitating the adhesion between the toner core particles and the fine polyester resin particles by plasticizing those particles without causing dissolution, since the plasticizing liquid needs to be removed from the capsule particles following the completion of the spray treatment, it is desirable to use a liquid which is easy evaporate. Preferred examples of such a liquid include alcohols such as ethanol, 1-propanol, isopropanol, butanol, and pentanol, and carbon hydrides such as octane, nonane, pentane, hexane, and heptane. Moreover, the use of such a liquid makes it possible to enhance the wettability of the fine polyester resin particles used as a coating material with respect to the toner core particles, to allow the fine polyester resin particles to adhere to the entire or most part of the surfaces of the toner core particles, and to facilitate the change in shape and filmization of the fine polyester resin particles. Further, such a liquid has a high vapor pressure, wherefore the time of drying required for liquid removal can be shortened with consequent successful prevention of aggregation of the toner core particles.

It is preferable that the plasticizing liquid has a viscosity of less than or equal to 5 cP. Alcohols may be given by way of preferred examples of a liquid having a viscosity of less than or equal to 5 cP, and more specifically ethanol and propanol fulfill the above requirement. Since these alcohols have a low viscosity and are also easy to evaporate, in a case where such an alcohol is contained in the plasticizing liquid, it never occurs that the plasticizing liquid is sprayed in the form of large-diameter droplets from the spraying section 203. This makes it possible to effect the spraying of the plasticizing liquid in the form of minute-diameter fine droplets, as well as to effect the spraying of the plasticizing liquid in the form of droplets of uniform diameter. Moreover, upon a collision between the capsule particles and the liquid droplets, the liquid droplets become even finer, whereby the surfaces of the capsule particles can be wetted uniformly and lubricated. Application of the fine liquid droplets in synergy with the collision energy helps soften the fine polyester resin particles with consequent formation of a capsule toner which is excellent in particle uniformity.

The viscosity of the plasticizing liquid is measured at 25° C. The viscosity of the plasticizing liquid can be measured, for example, by a cone/plate type rotation viscometer.

It is preferable that the plasticizing liquid is sprayed in such a manner that the concentration thereof in a gasified state measured by a concentration sensor in a gas discharge section 222 is less than or equal to 3%. The concentration of this level can be obtained by making proper changes to the physical properties and amounts of the toner core particles and the fine polyester resin particles, as well as to the speed with which the plasticizing liquid is sprayed in accordance with the scale of the rotary stirring apparatus 201.

(Cross-Linking Agent)

In the embodiment, the plasticizing liquid contains a cross-linking agent for developing cross-linkage between polyester resins comprised in the fine polyester resin particles. An isocyanate compound is desirable for use as the cross-linking agent. Polyester resin bears many terminal hydroxyl groups, and the terminal hydroxyl group of polyester resin contained in the surfaces of the fine polyester resin particles and the isocyanate compound react highly with each other to form a cross-linked structure readily. Moreover, since a cross-linking reaction proceeds at an adequate reaction rate, there is no need to secure much time for the cross-linkage with consequent successful prevention of aggregation of capsule toner particles in the film-forming process.

A disubstituted isocyanate compound having two isocyanate groups on a per-molecule basis is desirable for use as the isocyanate compound. In the isocyanate compound, two or more isocyanate groups on a per-molecule basis are required to form a cross-linked structure by making urethane linkage with the terminal hydroxyl group of polyester resin. However, if the number of isocyanate groups on a per-molecule basis is three or more, the reaction between the isocyanate group and the terminal hydroxyl group of polyester resin will be impaired, and, the larger is the number of the isocyanate groups, the likelier it becomes that some isocyanate groups remain unreacted. When an unreacted isocyanate group reacts with water in the air, then the capsule toner takes up moisture, which leads to the possibility of preservability deterioration.

Examples of the disubstituted isocyanate compound include hexamethylene diisocyanate, 1,4-diisocyanato butane, and 1,12-diisocyanate dodecane. Moreover, The isocyanate compounds may be used each alone, or two or more of them may be used in combination.

The concentration of the isocyanate compound should preferably be lower than or equal to 20% by weight, and more preferably at 1% by weight or more and 20% by weight or less. In this case, the isocyanate compound can be applied evenly to the surfaces of the plurality of fine polyester resin particles covering the toner core particles, with consequent successful prevention of aggregation of capsule toner particles in the film-forming process. Where the concentration of the isocyanate compound is less than 1% by weight, much time needs to be taken to complete cross linkage. This, of necessity, requires prolongation of the film-forming process, which increases the possibility of developing aggregation of capsule toner particles. On the other hand, where the concentration of the isocyanate compound is greater than 20% by weight, since cross linkage evolves more quickly than in the case where the concentration of the isocyanate compound is lower than or equal to 20% by weight, it is possible to shorten the time required for film formation. However, too short a film-formation time period gives rise to the risk that the fine polyester resin particles cannot be shaped into a film satisfactorily on the surfaces of capsule particles.

It is preferable that the isocyanate compound is sprayed in admixture with a hydrocarbon having a carbon atom number of greater than or equal to 5 but less than or equal to 8 or an alcohol having a carbon atom number of greater than or equal to 2 but less than or equal to 4. A hydrocarbon having a carbon atom number of less than 5 is highly likely to be volatilized at room temperature and is thus difficult to handle. By contrast, a hydrocarbon having a carbon atom number of greater than 8 cannot be used without the necessity of raising the processing temperature at which the capsule toner is dried following the stopping of plasticizing liquid spray treatment or the necessity of securing much processing time. In the case of using such a hydrocarbon, the resultant capsule toner will have smoothed surfaces free from irregularities and eventually take on a spherical form, which leads to the risk of a cleaning failure occurring on a photoreceptor or transfer belt.

An alcohol having a carbon atom number of less than 2 reacts highly with the isocyanate compound. Therefore, an isocyanate group reaction inconveniently occurs before the application of the isocyanate compound. By contrast, an alcohol having a carbon atom number of greater than 4 exhibits high resin dissolving capability. In the case of using such an alcohol, the resultant capsule toner will have smoothed surfaces and eventually take on a spherical form, which leads to the risk of a cleaning failure occurring on a photoreceptor or transfer belt.

(Carrier Gas)

Compressed air can be used as a carrier gas. Preferred flow rate of the carrier gas depends on spraying rate of plasticizing liquid which varies by the scale of the rotary stirring apparatus 201 and the amounts of the toner core particles and the fine polyester resin particles. Therefore, the flow rate of the carrier gas is appropriately regulated in conformity with the spraying rate of the plasticizing liquid.

In this step, spraying of the plasticizing liquid from the spraying section 203 is preferably initiated after the surface of the toner base particles and fluidizing rate of the capsule particles are stabilized in the powder passage 202. This can uniformly spray the liquid to the capsule particles. As a result, the yield of a capsule toner having uniform film state and particle size distribution can be improved.

An angle θ formed by a plasticizing liquid spraying direction which is a direction of the axis of the two-fluid nozzle and the powder flowing direction which is a direction in which the capsule particles flow in the powder passage 202 is preferably 0° or more and 45° or less. In a case where the angle θ falls within this range, the droplet of the plasticizing liquid is prevented from recoiling from the inner wall of the powder passage 202 and yield of the capsule toner is able to be further improved. In a case where the angle formed by the plasticizing liquid spraying from the spraying section 203 and the powder flowing direction exceeds 45°, the droplet of the plasticizing liquid easily recoils from the inner wall of the powder passage 202 and the plasticizing liquid is easily retained, thus generating aggregation of the capsule toner particles and deteriorating the yield. The two-fluid nozzle is provided so as to be inserted in the opening formed on the outer wall of the powder passage 202.

Further, a spreading angle θ of the plasticizing liquid sprayed by the two-fluid nozzle is preferably 20° or more and 90° or less. In a case where the spreading angle falls out of this range, it is likely to be difficult to spray the plasticizing liquid uniformly to the capsule particles.

(3)-4 Film-Forming Step S3*d*

At the film-forming step of step S3*d*, the rotary stirring section 204 continues the stirring at a predetermined temperature until a shell layer is formed on the surfaces of the capsule particles while performing the spraying of the plasticizing liquid and fluidizes the capsule particles.

In this step, by virtue of the synergetic effect produced by the temperature regulation, circulation, and force of stirring impact, and thermal energy evolved by the stirring operation as well, the fine polyester resin particles borne on the surfaces of the capsule particles are softened into a continuous film, and the terminal hydroxyl group of polyester resin and the isocyanate compound undergo a cross-linking reaction, with consequent formation of urethane linkage.

(3)-5 Collecting Step S3*e*

At the collecting step of step S3*e*, spraying of the plasticizing liquid from the spraying section 203 is finished, rotation of the rotary stirring section 204 is stopped, the capsule toner is ejected outside the apparatus from the powder collecting section 207, and the capsule toner is collected.

In this way, the capsule toner is manufactured, but the peripheral speed of the outermost periphery of the rotary stirring section 204 at the coating step S3 including steps S3*a* to S3*e* is preferably set to 30 m/sec or more, and more preferably to 50 m/sec or more. The outermost periphery of the rotary stirring section 204 is a part 204*a* of the rotary stirring section 204 that has the longest distance from the axis of the rotary shaft member 218 in the direction perpendicular to the extending direction of the rotary shaft member 218 of the rotary stirring section 204. In a case where the peripheral speed in the outermost periphery of the rotary stirring section 204 is at 30 m/sec or more at the time of rotation, it is possible to isolate and fluidize the toner core particles, the fine polyester resin and capsule particles. In a case where the peripheral speed in the outermost periphery is less than 30 m/sec, it is impossible to isolate and fluidize the toner core particles, the fine polyester resin particles and capsule particles, thus making it impossible to uniformly coat the toner core particles with the shell layer.

At the coating step S3, the internal temperature in the powder passage 202 is set to be lower than or equal to the glass transition temperature of the toner core particles. Preferably, the internal temperature in the powder passage 202 falls within the range of 30° C. or higher and not higher than the glass transition temperature of the toner core particle. The internal temperature in the powder passage 202 is kept substantially uniform throughout its interior because of the flowing action of the toner core particles. If the internal temperature in the powder passage 202 is greater than the glass transition temperature of the toner core particle, the toner core particles will be softened excessively, which leads to the possibility of developing aggregation of the toner core particles. By contrast, if the internal temperature in the powder passage 202 is less than 30° C., the dispersion liquid will be dried slowly, which may lead to poor productivity and also a sluggish reaction between the terminal hydroxyl group of polyester resin contained in the fine polyester resin particles and the cross-linking agent. In order to prevent aggregation of the toner core particles and to achieve satisfactory cross linkage, the temperatures of, respectively, the powder passage 202 and the rotary stirring section have to be maintained at the level of lower than or equal to the glass transition temperature of the toner core particle. Accordingly, there is a need to dispose, as a device capable of effecting temperature regulation, a temperature regulation jacket whose internal diameter is larger than the outer diameter of the powder passage tube in at least a part of the exterior of the powder passage tube and the rotary stirring section 204. Temperature regulation can be effected by admitting a cooling medium or a heating medium into the inner space of the temperature regulation jacket.

In the case of using an isocyanate compound as the cross-linking agent, it is preferable that the internal temperature in the powder passage 202 falls within the range of 35° C. or higher and 60° C. or lower. If the internal temperature in the powder passage 202 is less than 35° C., the terminal hydroxyl group of polyester resin and the isocyanate group will be less likely to react well with each other. By contrast, if the internal temperature in the powder passage 202 excesses 60° C., the resultant capsule toner will have smoothed surfaces and eventually take on a spherical form, which results in the risk of a cleaning failure occurring on a photoreceptor or transfer belt.

As described above, the rotary stirring section 204 includes the rotary disc 219 that is rotated with rotation of the rotary shaft member 218, the toner core particles, the fine polyester resin particles, and capsule particles preferably collide with the rotary disc 219 vertically to the rotary disc 219, and more preferably collide with the rotary shaft member 218 vertically to the rotary disc 219. Whereby, it is possible to stir the toner core particles, the fine polyester resin particles and the capsule particles more sufficiently than the case where the toner core particles, the fine polyester resin particles and capsule particles collide with the rotary disc 219 in parallel, thus making it possible to coat the toner core particles with the fine polyester resin particles more uniformly and to further improve yield of the capsule toner uniformly coated with the shell layer.

The plasticizing liquid sprayed is preferably gasified to have a constant gas concentration in the powder passage 202. Whereby, the concentration of the gasified plasticizing liquid in the powder passage 202 is kept constant and it is possible to make the drying speed of the substance in liquid form higher than the case where the concentration of the gasified plasticizing liquid is not kept constant, thus making it possible to prevent that the toner particles in which an undried plasticizing liquid is remained are adhered to other toner particles and to further suppress aggregation of the capsule toner particles. As a result, it is possible to further improve yield of the capsule toner uniformly coated with the shell layer.

The concentration of the gasified plasticizing liquid measured by a concentration sensor in a gas exhausting section 222 is preferably around 3% or less. In a case where the concentration of the gasified plasticizing liquid is around 3% or less, the drying speed of the plasticizing liquid is able to be increased sufficiently, thus making it possible to prevent adhesion of the undried capsule toner particles in which the plasticizing liquid is remained to other capsule toner particles and to prevent aggregation of the capsule toner particles. Moreover, the concentration of the gasified plasticizing liquid in the gas exhausting section 222 is more preferably 0.1% or more and 3.0% or less by the concentration sensor. In a case where the spraying speed falls within this range, it is possible to prevent aggregation of the capsule toner particles without deteriorating the productivity.

The gasified plasticizing liquid is preferably exhausted outside the powder passage through the through-hole 221 so that the gas concentration in the powder passage is kept constant. Whereby, the concentration of the gasified plasticizing liquid in the powder passage is kept constant and it is possible to make the drying speed of the plasticizing liquid in liquid form higher than the case where the concentration of the gasified plasticizing liquid is not kept constant, thus making it possible to prevent that the capsule toner particles in which an undried plasticizing liquid in liquid form is remained are adhered to other capsule toner particles and to further suppress aggregation of the toner particles. As a result, it is possible to further improve yield of the capsule toner uniformly coated with the shell layer.

As described above, the method of manufacturing a capsule toner according to the embodiment uses the rotary stirring apparatus 201, and the rotary stirring apparatus 201 comprises the circulating section, the temperature regulation section and the spraying section 203. The spraying section 203 comprises a two-fluid nozzle which sprays a plasticizing liquid for assisting adhesion between the toner core particles and the fine polyester resin particles from the liquid pipe and sprays the carrier gas from the air pipe. The two-fluid nozzle comprises the liquid pipe and the air pipe, the liquid pipe is inserted in the air pipe such that an axis of the liquid pipe coincides with an axis of the air pipe, and at least a part of the liquid pipe and the air pipe is fixed such that the centers of the liquid pipe and the air pipe do not move.

In the rotary stirring apparatus 201, the plasticizing liquid for assisting adhesion between the toner core particle and the fine polyester resin particles is sprayed in a constant rate from the two-fluid nozzle while regulating temperature and circulating the toner core particles and the fine polyester resin particles in the powder passage. In this case, the fine polyester resin particles can be plasticized by the synergistic effect of the circulating section and the temperature regulation section, thereby forming a film on the surface of the toner core particle. When the two-fluid nozzle having a structure such that the centers of the liquid pipe and the air pipe do not move is used in the production method of the toner capsule, even though circulating wind, and the circulating toner core particle and fine polyester resin particles collide with the two-fluid nozzle, the centers of the liquid pipe and the air pipe can be prevented from moving. Due to this, the amount of a carrier gas sprayed per unit area is constant and is stabilized in the cross-section of the tip of the air pipe. As a result, the direction of the plasticizing liquid sprayed and the spraying amount can be suppressed from being changed, and a stable spraying state can be maintained. Therefore, a plasticizing liquid concentration in the powder passage can be maintained constant, and a capsule toner having uniform film state and particle size distribution can be manufactured in a stable manner over a long period of time.

The configuration of a rotary stirring apparatus 201 is not limited to the above and various alterations may be added thereto. For example, the temperature regulation jacket may be provided over the outside of the powder flowing section 209 and the stirring section 208, or may be provided in a part of the outside of the powder flowing section 209 or the stirring section 208. In a case where the temperature regulation jacket is provided over the outside of the powder flowing section 209 and the stirring section 208, it is possible to prevent the toner core particles from being adhered to the inner wall of the powder passage 202 more reliably.

A capsule toner manufacturing apparatus for use, such as the rotary stirring apparatus 201, can be constructed of a combination of a commercially available stirrer and the spraying section. HYBRIDIZATION SYSTEM (trade name, manufactured by Nara Machinery Co., Ltd.) may be given by way of an example of commercially available stirrers having a powder passage and a rotary stirring section. By attaching a liquid spraying unit to such a stirrer interiorly thereof, the stirrer is able to serve as a capsule toner manufacturing apparatus.

(4) Capsule Toner

The capsule toner manufactured by the aforestated method of manufacturing the capsule toner in accordance with the second embodiment of the invention is characterized by the uniformity in coating amount of the fine polyester resin particles and thus the uniformity in capsule toner characteristics such as the charging characteristics of the individual capsule toner particles. Moreover, the capsule toner is excellent in durability by virtue of the inclusion-component protective effect produced by the shell layer borne on the surfaces of the constituent particles. By performing image formation with use of such a capsule toner, it is possible to form a good-quality image which exhibits high resolution and is free from unevenness in image density with stability.

To the capsule toner, an external additive may be added. As the external additive, heretofore known substances can be used including silica and titanium oxide. It is preferred that these substances be surface-treated with silicone resin and a silane coupling agent. A preferable usage of the external additive is 1 part by weight to 10 parts by weight based on 100 parts by weight of the toner.

3. Two-Component Developer (1) Two-Component Developer

The two-component developer pursuant to the invention includes the aforestated capsule toner and a carrier. Accordingly, the two-component developer of the embodiment is less likely to cause filming on a photoreceptor, exhibits good cleanability, and allows formation of high-quality images.

The two-component developer of the present embodiment can be formed by mixing the capsule toner and the carrier by a mixer such as Nauta Mixer. The capsule toner is blended in an amount of, for example, 3 to 15 parts by weight relative to 100 parts by weight of the carrier.

In producing the two-component developer of the present embodiment, it is preferable that the rate of capsule toner covering of the carrier falls within the range of 40% to 70%. If the covering rate is less than 40%, a sufficiently high image density could be unobtainable. By contrast, if the covering rate is greater than 70%, the added capsule toner will not be intimately admixed by the stirring roller, with the consequence that fogging could happen to a printed image due a charging failure.

(2) Carrier

As the carrier, for example, a resin-coated type carrier can be used that is formed by applying a coating of resin layer to the surface of a carrier core material.

(Carrier Manufacturing Method)

The carrier can be produced by applying a resin coating to ferrite or magnetite used as the carrier core material in accordance with a heretofore known method such as the spray method, the fluid bed method, and the kneader caster method. By way of specific examples, there are given: the immersion method for soaking the carrier core material in an organic solvent solution prepared by dissolving resin in toluene, xylene, or the like substance; the spray method for spraying the organic solvent solution onto the carrier core material; the fluid bed method for spraying the organic solvent solution onto the carrier core material in a state of being floated by flowing air; and the kneader coater method involving a step of mixing the carrier core material and the organic solvent solution in a kneader coater and a step of removing the solvent medium.

In addition to the resin, an electrically conductive agent for resistance value control may be added to the organic solvent solution on an as needed basis. The resin coating applied to the surface of the carrier core material is heated to undergo thermal hardening at temperatures ranging from 180° C. to 280° C. in a stationary heating apparatus or an oven.

(Carrier Core Material)

Heretofore known ferrite particles can be used as the carrier core material. Specific examples thereof include zinc-based ferrite, nickel-based ferrite, copper-based ferrite, nickel and zinc-based ferrite, manganese and magnesium-based ferrite, copper and magnesium-based ferrite, manganese and zinc-based ferrite, and manganese, copper, and zinc-based ferrite.

The ferrite particles such as shown herein can be formed by heretofore known methods. For example, ferrite raw materials such as $Fe_2O_3$ and $Mg(OH)_2$ are mixed together, and the admixture powder is subjected to calcination under application of heat in a heating furnace. The resultant calcined product is cooled down and is whereafter pulverized by a vibrational mill into fine particles having an average particle size of 2 μm or below. Then, a dispersant and water are added to the pulverized powder to prepare a slurry. The slurry is wet-milled by a wet ball mill, and the resultant suspension liquid is dry-granulated by a spray drier. In this way, there are obtained ferrite particles.

(Resin Layer)

The resin layer is formed on the surface of the carrier core material. Heretofore known resin materials can be used as a resin to be contained in the resin layer. To be specific, while a silicone resin, an acrylic resin, or the like can be used, the use of a thermosetting straight silicone resin is desirable that exhibits low surface energy and is less prone to adhesion of an external additive and a releasing agent. Examples of the thermosetting straight silicone resin include a dimethyl silicone resin, a methyl phenyl silicone resin, and a methyl hydrogen silicone resin. As shown in the following chemical formula (1), the thermosetting straight silicone resin is one of heretofore known silicone resins of the type that are hardened through cross linkage of hydroxyl groups linked to Si atoms resulting for example from a thermal dehydration reaction.

Thermal dehydration reaction (1)

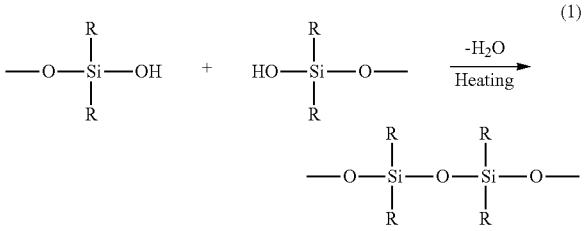

Where, a plurality of symbols "R" of the formula represent the same or different monovalent organic groups.

The monovalent organic group R can be, for example, a methyl group, a phenyl group, an ethyl group, and a propyl group. Among them, a methyl group is desirable. A crosslinkable silicone resin in which R defines a methyl group has a dense cross-linked structure and thus serves the purpose of forming a carrier having excellent water repellency and moisture resistance. However, if the cross-linked structure is excessively densified, the resin layer will apt to brittle, wherefore the selection of molecular weight in the crosslinkable silicone resin takes on importance.

An electrically conductive agent may be added to the resin layer for carrier volume resistivity control. Examples of the electrically conductive agent include silicon oxide, alumina, carbon black, graphite, zinc oxide, titanium black, iron oxide, titanium oxide, tin oxide, potassium titanate, calcium titanate, aluminum borate, magnesium oxide, barium sulfate, and calcium carbonate. Among those electrically conductive agents, carbon black is desirable from the viewpoint of production stability, cost, lowness in electrical resistance. While the kind of carbon black is not particularly restricted, the ones ranging in DBP (dibutyl phthalate) oil absorbency from 90 ml/100 g to 170 ml/100 g are desirable for use from the standpoint of providing excellent production stability. Moreover, carbon black which measures 50 nm or below in terms of primary particle size (the number average particle diameter of primary particles measured under a scanning electron microscope, the number of target particles being ca. 200, for instance) is particularly desirable because of its excellent dispersibility. The electrically conductive agents may be used each alone, or two or more of them may be used in combination. It is preferable that the electrically conductive agent is added in an amount of 0.1 to 20 parts by weight relative to 100 parts by weight of the resin.

(Carrier)

It is preferable that the carrier has a volume average particle size failing within the range of 30 μm or more and 50 μm or less. If the volume average particle size of the carrier is less than 30 μm, due to the movement of the carrier from a developing roller to the photoreceptor in the course of development, a resultant image could suffer from a white patch, or friar. By contrast, if the volume average particle size is greater than 50 μm, the dot reproducibility becomes so poor that the resultant image appears grainy.

The volume average particle size of the carrier is measured by the laser diffraction scattering method. The volume average particle size measurement based on the laser diffraction scattering method can be carried out with use of Microtrac particle size analyzer Model MT 3300 (manufactured by NIKKISO CO., LTD), for example.

EXAMPLES

Property Measurement Method

[Glass Transition Temperature of Binder Resin and Toner Core Particle]

Using a differential scanning calorimeter (trade name: DSC220, manufactured by Seiko Instruments & Electronics Ltd.), 1 g of specimen was heated at a temperature increasing rate of 10° C./min to measure a DSC curve based on Japanese Industrial Standards (JIS) K7121-1987. A temperature at an intersection of a straight line that was elongated toward a low-temperature side from a base line on the high-temperature side of an endothermic peak corresponding to glass transition of the obtained DSC curve and a tangent line that was drawn so that a gradient thereof was maximum against a curve extending from a rising part to a top of the peak was obtained as the glass transition temperature (Tg).

[Softening Temperature of Binder Resin]

Using a flow characteristic evaluation apparatus (trade name: FLOW TESTER CFT-100C, manufactured by Shimadzu Corporation), 1 g of specimen was heated at a temperature increasing rate of 6° C./min, under load of 20 kgf/cm2 ($19.6\times10^5$ Pa) so that the specimen was pushed out of a dye (nozzle opening diameter of 1 mm and length of 1 mm) and a temperature at the time when a half of the specimen had flowed out of the dye was obtained as the softening temperature (Tm).

[Melting Point of Release Agent]

Using the differential scanning calorimeter (trade name: DSC220, manufactured by Seiko Instruments & Electronics Ltd.), 1 g of specimen was heated from a temperature of 20 up to 200° C. at a temperature increasing rate of 10° C./min, and then an operation of rapidly cooling down from 200° C. to 20° C. was repeated twice, thus measuring a DSC curve. A temperature at a top of an endothermic peak corresponding to the melting on the DSC curve measured at the second operation, was obtained as the melting point of the release agent.

[Volume average particle sizes of toner core particle, fine polyester resin particle and capsule toner]

To 50 ml of electrolyte (trade name: ISOTON-II, manufactured by Beckman Coulter, Inc.), 20 mg of specimen and 1 ml of sodium alkylether sulfate were added, and a thus-obtained admixture was subjected to dispersion processing of an ultrasonic distributor (trade name: desktop two-frequency ultrasonic cleaner VS-D100, manufactured by AS ONE Corporation) for three minutes at an ultrasonic frequency of 20 kHz, thereby preparing a specimen for measurement. The measurement sample was analyzed by a particle size distribution-measuring device: MOLTISIZER III (trade name) manufactured by Beckman Coulter, Inc. under the conditions that an aperture diameter was 100 μm and the number of particles for measurement was 50,000 counts. A volume particle size distribution of the sample particles was thus obtained from which the volume average particle size was then determined.

[Volume Average Particle Size of Carrier Core Particles]

The volume average particle size of the carrier has been determined by the laser diffraction scattering method.

[Volume Resistivity of Carrier Core Particles]

The volume resistivity of the carrier core particles has been determined by the bridge method.

Example 1

Toner Core Particle Producing Step S1

Raw materials of the toner core particles and addition amounts thereof were as follows:

| | |
|---|---|
| Polyester resin (trade name: DIACRON, manufactured by Mitsubishi Rayon Co., Ltd., glass transition temperature of 55° C., softening temperature of 100° C.) | 87.5% (100 parts by weight) |
| Colorant (C. I. Pigment Blue 15:3) | 5.0% (5.7 parts by weight) |
| Release agent (Carunauba Wax, melting point of 82° C.) | 6.0% (6.9 parts by weight) |
| Charge control agent (trade name: Bontron E84, manufactured by Orient Chemical Industries, Ltd.) | 1.5% (1.7 parts by weight) |

After pre-mixing each of the constituent materials described above by a Henschel mixer (trade name: FM20C, manufactured by Mitsui Mining Co., Ltd.), the obtained mixture was melt-kneaded by a twin-screw extruder (trade name: PCM65 manufactured by Ikegai, Ltd.). After coarsely pulverizing the melt-kneaded material by a cutting mill (trade name: VM-16, manufactured by Orient Co., Ltd.), it was finely pulverized by a jet mill (manufactured by Hosokawa Micron Corporation) and then classified by a pneumatic classifier (manufactured by Hosokawa Micron Corporation) to thereby produce toner core particles with a volume average particle size of 6.5 μm and a glass transition temperature of 56° C.

[Fine Resin Particle Preparing Step S2]

A compound made by the polymerization of terephthalic acid and bisphenol A has been freeze-dried into fine resin particles. The resultant fine polyester resin particles (glass transition temperature: 65° C., softening temperature: 117° C.) have a volume average particle size of 0.15 μm.

[Coating Step S3]

The apparatus used at this step was constructed by attaching the spraying section to Hybridization System (trade name: Model NHS-1, manufactured by Nara Machinery Co., Ltd.) that is equivalent to the apparatus as illustrated in FIGS. 2 and 3. A 15% hexamethylene diisocyanate-ethanol solution was used as the plasticizing liquid. As the liquid spraying unit, a unit constructed by connecting a liquid-feeding pump (trade name: SP 11-12, manufactured by FLOM Co., Ltd.) to the two-fluid nozzle as illustrated in FIG. 5 was used. In this unit, the plasticizing liquid is fed in a fixed amount to the two-fluid nozzle through the liquid-feeding pump. In the two-fluid nozzle, the internal diameter of the liquid tube is 1.0 mm, the internal diameter of the air tube is 3.0 mm, and the ratio of the air-tube internal diameter to the liquid-tube internal diameter is 1:3. Moreover, the angles $\theta_1$ and $\theta_2$ of the adhesion preventive member are 50°, respectively. The rate at which the plasticizing liquid is sprayed and the rate at which a liquid gas resulting from gasification of the plasticizing liquid were observed by means of a commercially available gas detector (trade name: XP-3110m, manufactured by NEW COSMOS ELECTRIC Co., Ltd.)

The temperature regulation jacket was provided over the entire surface of the powder flowing section and the wall surface of the stirring section and regulated so that a temperature in the powder flowing section and the stirring section became 50° C. A temperature sensor was installed in the powder passage. The peripheral speed in the outermost periphery of the rotary stirring section of the Hybridization system was 100 m/sec at the fine resin particle adhering step S3*b*. The peripheral speed was also 100 m/sec at the spraying step S3*c* and the film-forming step S3*d*. Moreover, an installation angle of the two-fluid nozzle was set so that an angle formed by the liquid spraying direction and the powder flowing direction is in parallel (0°).

With use of such an apparatus, 100 parts by weight of the toner core particles and 10 parts by weight of the fine polyester resin particles thereby prepared have been mixed and stirred for five minutes. Then, the toner core particles and the fine polyester resin particles in a fluidized state under stirring have been sprayed with the plasticizing liquid by means of the two-fluid nozzle under conditions where the two-fluid nozzle effects the spraying of the plasticizing liquid at the rate of 1.0 g per minute and the rate of flow of air is 5 L per minute. 30-minute spray treatment has been carried out to change the fine polyester resin particles into a film-like state on the surfaces of the toner core particles. After that, 10-minute stirring operation has been carried out following the stopping of the plasticizing liquid spray treatment. In this way, a capsule toner of Example 1 was obtained. At this time, the concentration of the plasticizing liquid discharged through the through hole and the gas discharge section was found to be approximately 2.8 Vol % in a condition of stability. Moreover, the rate of flow of air admitted into the powder passage was set at 10 L per minute. More specifically, the rate of flow of air admitted via the rotary shaft into the powder passage is adjusted to 5 L per minute, and, when this rate and the rate of flow of air admitted from the two-fluid nozzle are added together, then it comes to 10 L/min.

Example 2

A capsule toner of Example 2 was obtained in the same manner as in the case of Example 1, except that, at the coating step S3, a 20% hexamethylene diisocyanate-ethanol solution was used for the spray treatment instead of the 15% hexamethylene diisocyanate-ethanol solution.

Example 3

A capsule toner of Example 3 was obtained in the same manner as in the case of Example 1, except that, at the coating step S3, a 22% hexamethylene diisocyanate-ethanol solution was used for the spray treatment instead of the 15% hexamethylene diisocyanate-ethanol solution.

Example 4

A capsule toner of Example 4 was obtained in the same manner as in the case of Example 1, except that, at the coating step S3, a 15%-1,5-diisocyanato-3-isocyanato methyl pentane-ethanol solution was used for the spray treatment instead of the 15%-hexamethylene diisocyanate-ethanol solution.

Example 5

A capsule toner of Example 5 was obtained in the same manner as in the case of Example 1, except that, at the coating step S3, a 15% hexamethylene diisocyanate-t-butanol solution was used for the spray treatment instead of the 15% hexamethylene diisocyanate-ethanol solution.

Example 6

A capsule toner of Example 6 was obtained in the same manner as in the case of Example 1, except that, at the coating step S3, a 15% hexamethylene diisocyanate-3-pentanol solution was used for the spray treatment instead of the 15% hexamethylene diisocyanate-ethanol solution.

Example 7

A capsule toner of Example 7 was obtained in the same manner as in the case of Example 1, except that, at the coating step S3, a 15% hexamethylene diisocyanate-n-pentane solution was used for the spray treatment instead of the 15% hexamethylene diisocyanate-ethanol solution.

Example 8

A capsule toner of Example 8 was obtained in the same manner as in the case of Example 1, except that, the coating step S3, a 15% hexamethylene diisocyanate-n-octane solution was used for the spray treatment instead of the 15% hexamethylene diisocyanate-ethanol solution.

Example 9

A capsule toner of Example 9 was obtained in the same manner as in the case of Example 1, except that, at the coating step S3, a 15% hexamethylene diisocyanate-n-nonane solution was used for the spray treatment instead of the 15% hexamethylene diisocyanate-ethanol solution.

Example 10

A capsule toner of Example 10 was obtained in the same manner as in the case of Example 1, except that, at the coating step S3, the temperatures of, respectively, the powder flowing section and the stirring section were regulated to 30° C.

Example 11

A capsule toner of Example 11 was obtained in the same manner as in the case of Example 1, except that, at the coating step S3, the temperatures of, respectively, the powder flowing section and the stirring section were regulated to 35° C.

Example 12

A capsule toner of Example 12 was obtained in the same manner as in the case of Example 1, except that, at the coating step S3, the temperatures of, respectively, the powder flowing section and the stirring section were regulated to 60° C.

Example 13

A capsule toner of Example 13 was obtained in the same manner as in the case of Example 1, except that, at the coating step S3, the temperatures of, respectively, the powder flowing section and the stirring section were regulated to 65° C.

Example 14

A capsule toner of Example 14 was obtained in the same manner as in the case of Example 1, except that, at the coating step S3, a 15% 1,4-diisocyanato butane-ethanol solution was used for the spray treatment instead of the 15% hexamethylene diisocyanate-ethanol solution.

Example 15

A capsule toner of Example 15 was obtained in the same manner as in the case of Example 1, except that, at the coating step S3, a 15% 1,12-diisocyanato dodecane-ethanol solution was used for the spray treatment instead of the 15% hexamethylene diisocyanate-ethanol solution.

Comparative Example 1

A capsule toner of Comparative Example 1 was obtained in the same manner as in the case of Example 1, except that, at the coating step S3, ethanol was used for the spray treatment instead of the 15% hexamethylene diisocyanate-ethanol solution.

Comparative Example 2

A capsule toner of Comparative Example 2 was obtained in the same manner as in the case of Comparative Example 1, except that, at the fine resin particle adhering step S3*b* of the coating step S3, the peripheral speed at the outermost periphery of the rotary stirring section of the Hybridization System was set at 160 m/sec instead of 100 m/sec.

(Production of Two-Component Developer)

The carrier was formed in accordance with the following method.

As ferrite raw materials, MgO in an amount of 3% by weight, MnO in an amount of 20% by weight, and $Fe_2O_3$ in an amount of 77% by weight have been mixed together by a ball mill, and the admixture has been calcined at 900° C. in a rotary kiln. The resultant calcined powder has been pulverized into fine particles having an average particle size of smaller than or equal to 2 μm by a wet grinding mill using steel balls as a crushing medium. Then the resultant fine ferrite powder was subjected to granulation in accordance with the spray drying method, and the granular product has been fired at 1300° C. Following the completion of the firing process, the product has been crushed by a crusher thereby to obtain ferrite component-made carrier core particles having a volume average particle size of 39 μm and a volume resistivity falling within the range of $1\times10^7$ Ω·cm to $1\times10^8$ Ω·cm.

Next, a coating fluid was prepared to cover the carrier core particles in the following manner. In 100 parts by weight of toluene, 20 parts by weight of a thermosetting straight silicone resin having number average molecular weight of 12,000 (trade name: KR 271, manufactured by Shin-Etsu Chemical Co., Ltd.) and 1 part by weight of carbon back (25 nm in primary particle size, 150 ml/100 g in oil absorbency) are dissolved and dispersed.

In a spray coating apparatus (trade name: SPIRA COTA (registered trademark), manufactured by Okada Seiko Co., Ltd.), 100 parts by weight of the carrier core material and 40 parts by weight of the coating fluid thereby prepared were placed to perform coating operation for 60 minutes, during which period the toluene was completely removed by evaporation. In this way, the ferrite component-made carrier core particles were covered with resin. After that, heat was applied thereto at a temperature of 240° C. to cure the thermosetting straight silicone resin, whereupon there was formed a carrier having a volume average particle size of 40 μm.

In Nauta Mixer (trade name: Model VL-0, manufactured by Hosokawa Micron Corporation), 7 parts by weight of each of the capsule toner samples obtained by way of Examples 1 to 15 and Comparative Examples 1 and 2 and 93 parts by weight of the thereby obtained carrier were placed, and they have been mixed together under stirring operation for 40 minutes thereby to form a two-component developer.

(Preservability)

The capsule toner samples obtained by way of Examples 1 to 15 and Comparative Examples 1 and 2 were each filled in an amount of 20 g in a 50-milliliter plastic bottle (AIBOHI, manufactured by AS ONE Corporation) and left to stand for 48 hours under the environmental conditions of a temperature of 50° C. and a humidity of 50%. After that, toner flowability was visually checked under the environmental conditions of a temperature of 25° C. and a humidity of 50%. Among the capsule toner samples, the one in which the level of toner flowability observed after a lapse of 48 hours differs little from the original level was rated as "Good", the one in which the level of toner flowability slightly declines but no toner aggregation is developed was rated as "Not bad", and the one in which toner aggregation takes place was rated as "Poor".

(Photoreceptor Filming Resistance and Cleanability)

Evaluation was conducted as to photoreceptor filming resistance and cleanability by performing continuous printing tests with use of the thereby obtained two-component developer in the following manner.

An image forming apparatus (modified model of a digital full-color multifunction printer (trade name: MX-4500N, manufactured by Sharp corporation) was used in the continuous printing tests. For the filling of the two-component developer, only one of the four image forming units of the image forming apparatus was used. The conditions for effecting development in the image forming apparatus are as follows: the peripheral speed of the photoreceptor is 400 mm/sec; the peripheral speed of the developing roller is 560 mm/sec; the size of a gap between the photoreceptor and the developing roller is 0.45 mm; the size of a gap between the developing roller and the regulating blade is 0.4 mm; and the surface potential of the photoreceptor and the development bias are so adjusted that the amount of adherent toner constituting a solid image (100% in density) printed on a paper sheet is 0.5 mg/cm$^2$ and the amount of toner adhering to the non-image area of the paper sheet is kept at a minimum. A4-size electrophotographic paper (MULTI RECEIVER, manufactured by Sharp Document Systems Corporation) was used as the test paper. Under those conditions, 50000 (50K) sheets of copies bearing solid images were produced. The photoreceptor filming resistance was assessed by checking the photoreceptor which has gone through printing of 50K-copies and the image of a 50K-th copy, and also cleanability was assessed by checking the photoreceptor and transfer belt that have gone through printing of 50K-copies and the image of the 50K-th copy.

In making an assessment of the photoreceptor filming resistance, the surface of the photoreceptor was visually checked by means of a digital microscope (trade name: VHX-600, manufactured by Keyence Corporation) at a magnification of 200 times. Among the capsule toner samples, the one that posed neither filming on the photoreceptor nor image imperfection on the test copy was rated as "Good", the one that posed no image imperfection on the copy sample in spite of occurrence of somewhat filming on the photoreceptor was rated as "Not bad", and the one that posed both filming on the photoreceptor and image imperfection on the test copy was rated as "Poor".

In making an assessment of cleanability, the surfaces of, respectively, the photoreceptor and the transfer belt were visually checked. Among the capsule toner samples, the one that did not pose any cleaning failure on both of the photoreceptor surface and the transfer belt surface and thus on the test copy was rated as "Good", the one that did not pose any cleaning failure on the transfer belt surface, but posed it on the photoreceptor surface and thus on the test copy was rated as "Not bad", and the one that posed cleaning failure on both of the photoreceptor surface and the transfer belt surface and thus on the test copy was rated as "Poor". Note that, when a black streak appearing on the non-image area of the test copy exhibits an image density of 0.3 or above, then the test copy is judged to suffer from cleaning failure. The result of evaluation is shown in Table 1.

TABLE 1

| | Plasticizing liquid | | | Internal temperature | | | Filming | |
|---|---|---|---|---|---|---|---|---|
| | Cross-linking agent | Solvent | Concentration (%) | in powder passage (° C.) | Peripheral speed (m/sec) | Preservability Evaluation | resistance Evaluation | Cleanability Evaluation |
| Ex. 1 | Hexamethylene diisocyanate | Ethanol | 15 | 50 | 100 | Good | Good | Good |
| Ex. 2 | Hexamethylene diisocyanate | Ethanol | 20 | 50 | 100 | Good | Good | Good |
| Ex. 3 | Hexamethylene diisocyanate | Ethanol | 22 | 50 | 100 | Not bad | Good | Good |
| Ex. 4 | 1,5-diisocyanato-3-isocyanato methyl pentane | Ethanol | 15 | 50 | 100 | Not bad | Good | Good |
| Ex. 5 | Hexamethylene diisocyanate | t-butanol | 15 | 50 | 100 | Good | Good | Good |
| Ex. 6 | Hexamethylene diisocyanate | 3-pentanol | 15 | 50 | 100 | Good | Good | Not bad |
| Ex. 7 | Hexamethylene diisocyanate | n-pentane | 15 | 50 | 100 | Good | Good | Good |
| Ex. 8 | Hexamethylene diisocyanate | n-octane | 15 | 50 | 100 | Good | Good | Good |
| Ex. 9 | Hexamethylene diisocyanate | n-nonane | 15 | 50 | 100 | Good | Good | Not bad |
| Ex. 10 | Hexamethylene diisocyanate | Ethanol | 15 | 30 | 100 | Good | Not bad | Good |
| Ex. 11 | Hexamethylene diisocyanate | Ethanol | 15 | 35 | 100 | Good | Good | Good |
| Ex. 12 | Hexamethylene diisocyanate | Ethanol | 15 | 60 | 100 | Good | Good | Good |
| Ex. 13 | Hexamethylene diisocyanate | Ethanol | 15 | 65 | 100 | Good | Good | Not bad |
| Ex. 14 | 1,4-diisocyanato butane | Ethanol | 15 | 50 | 100 | Good | Good | Good |

TABLE 1-continued

| | Plasticizing liquid | | | Internal temperature | | | Filming | |
|---|---|---|---|---|---|---|---|---|
| | Cross-linking agent | Solvent | Concen-tration (%) | in powder passage (° C.) | Peripheral speed (m/sec) | Preservability Evaluation | resistance Evaluation | Cleanability Evaluation |
| Ex. 15 | 1,12-diisocyanato dodecane | Ethanol | 15 | 50 | 100 | Good | Good | Good |
| Comp. Ex. 1 | — | Ethanol | — | 50 | 100 | Not bad | Poor | Good |
| Comp. Ex. 2 | — | Ethanol | — | 50 | 160 | Good | Good | Poor |

<Result of Evaluation>

As shown in Table 1, the capsule toner samples obtained by way of Examples 1 to 15 have proven that they are excellent in all of preservability, filming resistance, and cleanability.

However, Example 3, which employs a plasticizing liquid with a cross-linking agent concentration of 22% for the spray treatment, posed a slight decline in preservability. This is because Example 3 was produced under the same conditions (such as plasticizing-liquid spray duration time) as in the case of Example 1 even though the cross-linking agent concentration is higher than in the case of Example 1. That is, the number of unreacted isocyanate groups is increased and a reaction occurs between the unreacted isocyanate group and water in the air, with consequent preservability deterioration.

Example 4 also posed a slight decline in preservability. This is because the number of unreacted isocyanate groups is increased due to the use of a cross-linking agent containing three isocyanate groups on a per-molecule basis.

Example 6 posed a slight decline in cleanability due to the use of an alcohol having a carbon atom number of 5 as the plasticizing liquid.

Example 9 posed a slight decline in cleanability due to the use of a hydrocarbon having a carbon atom number of 9 as the plasticizing liquid.

Example 10 posed a slight decline in photoreceptor filming resistance. This is because the cross-linking reaction did not proceed well due to the internal temperature in the powder passage set at 30° C.

Example 13 posed a slight decline in cleanability. This is because the internal temperature in the powder passage was set at 65° C. and the resultant capsule toner is relatively spherical in form.

Comparative Example 1 posed poor filming resistance due to the use of a cross-linking agent-free plasticizing liquid. In addition, Comparative Example 2 posed poor cleanability. This is because a cross-linking agent-free plasticizing liquid was used therein and the peripheral speed of the rotary stirring section was set to be higher than in the cases of Examples. It will thus be seen that, even if a cross-linking agent-free plasticizing liquid is used, a capsule toner in which separation of the fine polyester resin particles is less likely to occur can be obtained by increasing the peripheral speed of the rotary stirring section, but the shell layer bears little irregularities with consequent cleanability deterioration instead. In conclusion, it is difficult to achieve both of satisfactory photoreceptor filming resistance and satisfactory cleanability without the use of a cross-linking agent.

The invention may be embodied in other specific forms without departing from the spirit or essential characteristics thereof. The embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A capsule toner comprising:

a core particle; and a shell layer for covering a surface of the core particle, the shell layer being formed of a cross-linked plurality of fine polyester resin particles each comprising polyester resins cross-linked to each other by a cross-linking agent, the core particle comprising polyester resin, and the polyester resin comprised in the core particle and the polyester resins comprised in the fine polyester resin particles constituting the shell layer being cross-linked to each other by a cross-linking agent.

2. A method of manufacturing a capsule toner using a rotary stirring apparatus, the rotary stirring apparatus comprising:

a rotary stirring section including a rotary disk having rotary blades installed therearound and a rotary shaft, for stirring capsule particles each composed of a core particle comprising polyester resin and a plurality of fine polyester resin particles adhering to surface of the core particle under application of impact force;

a circulating section having a powder passage including a circulating tube and a rotary stirring chamber to accommodate the rotary stirring section, and circulating the capsule particles in the powder passage by an air current produced by rotation of the rotary blades; and a spraying section for spraying a plasticizing liquid for plasticizing the fine polyester resin particles onto the capsule particles, the plasticizing liquid containing a cross-linking agent for developing cross linkage between the polyester resins comprised in the plurality of fine polyester resin particles and the core particle, respectively, the method comprising:

a film-forming process of forming a shell layer by spraying the plasticizing liquid onto the capsule particles so as to achieve cross linkage and fusion bonding between the polyester resins comprised in the plurality of fine polyester resin particles, respectively, and achieving cross linkage between the polyester resin comprised in the core particle and the polyester resins comprised in the plurality of fine polyester resin particles forming the shell layer, respectively.

3. The method of claim 2, wherein the cross-linking agent is made of an isocyanate compound.

4. The method of claim 3, wherein the concentration of the isocyanate compound contained in the plasticizing liquid falls within the range of 1% by weight or more and 20% by weight or less.

5. A method of manufacturing a capsule toner using a rotary stirring apparatus, the rotary stirring apparatus comprising:

a rotary stirring section including a rotary disk having rotary blades installed therearound and a rotary shaft, for stirring capsule particles each composed of a core particle comprising polyester resin and a plurality of fine polyester resin particles adhering to the surface of the core particle under application of impact force;

a circulating section having a powder passage including a circulating tube and a rotary stirring chamber to accommodate the rotary stirring section, and circulating the capsule particles in the powder passage by an air current produced by the rotation of the rotary blades;

a temperature regulation section disposed in at least a part of the powder passage, for regulating the temperatures of the interior of the powder passage and the rotary stirring section to predetermined temperatures; and a spraying section for spraying a plasticizing liquid for plasticizing the fine polyester resin particles onto the capsule particles, the method comprising:

a film-forming process of spraying the plasticizing liquid onto the capsule particles while causing the capsule particles to flow by rotating the rotary stirring section continuously until the plurality of fine polyester resin particles are softened into a film-like form and cross linkage between the polyester resin comprised in the core particle and the polyester resins comprised in the plurality of fine polyester resin particles forming a shell layer are achieved respectively, the plasticizing liquid containing an isocyanate compound, the rotary stirring section being operated at an outermost peripheral speed falling within a range of 30 m/s or above and 120 m/s or below, and an internal temperature in the powder passage falling within a range of 30° C. or higher and 65° C. or lower.

6. The method of claim 5, wherein the concentration of the isocyanate compound contained in the plasticizing liquid falls within the range of 1% by weight or more and 20% by weight or less.

* * * * *